US010961652B2

(12) United States Patent
Gasparini et al.

(10) Patent No.: US 10,961,652 B2
(45) Date of Patent: Mar. 30, 2021

(54) METHOD FOR TREATING LAUNDRY IN A LAUNDRY WASHING MACHINE AND LAUNDRY WASHING MACHINE

(71) Applicant: Electrolux Appliances Aktiebolag, Stockholm (SE)

(72) Inventors: Mirko Gasparini, Spilimbergo (IT); Elisa Stabon, Gorizia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 34 days.

(21) Appl. No.: 15/563,307

(22) PCT Filed: Apr. 1, 2015

(86) PCT No.: PCT/EP2015/057159

§ 371 (c)(1),
(2) Date: Sep. 29, 2017

(87) PCT Pub. No.: WO2016/155813

PCT Pub. Date: Oct. 6, 2016

(65) Prior Publication Data

US 2018/0119329 A1 May 3, 2018

(51) Int. Cl.

| | |
|---|---|
| ***D06F 39/02*** | (2006.01) |
| ***D06F 35/00*** | (2006.01) |
| ***D06F 33/00*** | (2020.01) |
| ***D06F 34/18*** | (2020.01) |
| ***D06F 34/22*** | (2020.01) |
| ***D06F 34/28*** | (2020.01) |
| ***D06F 23/02*** | (2006.01) |
| ***D06F 37/22*** | (2006.01) |
| ***D06F 37/26*** | (2006.01) |
| ***D06F 37/30*** | (2020.01) |
| ***D06F 37/36*** | (2006.01) |
| ***D06F 39/00*** | (2020.01) |
| ***D06F 39/04*** | (2006.01) |
| ***D06F 39/08*** | (2006.01) |
| ***D06F 39/10*** | (2006.01) |
| ***D06F 39/12*** | (2006.01) |
| ***D06F 21/00*** | (2006.01) |

(52) U.S. Cl.

CPC ..... *D06F 39/028* (2013.01); *D06F 23/02* (2013.01); *D06F 33/00* (2013.01); *D06F 34/18* (2020.02); *D06F 34/22* (2020.02); *D06F 34/28* (2020.02); *D06F 35/005* (2013.01); *D06F 35/006* (2013.01); *D06F 37/22* (2013.01); *D06F 37/266* (2013.01); *D06F 37/304* (2013.01); *D06F 37/36* (2013.01); *D06F 39/007* (2013.01); *D06F 39/045* (2013.01); *D06F 39/085* (2013.01); *D06F 39/087* (2013.01); *D06F 39/088* (2013.01); *D06F 39/10* (2013.01); *D06F 39/12* (2013.01); *D06F 21/00* (2013.01); *D06F 2202/02* (2013.01); *D06F 2202/04* (2013.01); *D06F 2204/04* (2013.01); *D06F 2204/065* (2013.01); *D06F 2204/082* (2013.01); *D06F 2204/084* (2013.01); *D06F 2204/086* (2013.01); *D06F 2220/00* (2013.01)

(58) Field of Classification Search

CPC .... D06F 39/003; D06F 39/004; D06F 39/005; D06F 39/007; D06F 39/028; D06F 39/045; D06F 39/085; D06F 39/087; D06F 39/088; D06F 39/10; D06F 39/12; D06F 35/005; D06F 23/02; D06F 33/02; D06F 37/22; D06F 37/266; D06F 37/304; D06F 37/36; D06F 34/22; D06F 34/18; D06F 34/28; D06F 21/00; D06F 2202/02; D06F 2202/04; D06F 2204/04; D06F 2204/065; D06F 2204/082; D06F 2204/084; D06F 2204/086; D06F 2220/00

See application file for complete search history.

(56) References Cited

U.S. PATENT DOCUMENTS 5,737,790 A * 4/1998 Badger ..... D06F 35/006 8/158
2004/0219081 A1* 11/2004 Fine ..... B01F 3/088 422/266

(Continued)

FOREIGN PATENT DOCUMENTS

| | | | |
|---|---|---|---|
| EP | 0726349 | A2 | 8/1996 |
| EP | 2287378 | A1 | 2/2011 |
| WO | 2015022002 | A1 | 2/2015 |

OTHER PUBLICATIONS

International Search Report dated Jun. 16, 2015 in corresponding International Application No. PCT/EP2015/057159.

*Primary Examiner* — Amina S Khan
(74) *Attorney, Agent, or Firm* — RatnerPrestia

(57) ABSTRACT

A method is provided for treating laundry in a laundry washing machine. The method includes at least one washing phase during which the laundry is washed with introduction of water and the detergent into a washing tub and tumbled by rotation of a washing drum, at least one successive draining phase for draining liquid from the washing tub and following the draining phase at least one rinsing step in which the laundry is soaked with water, and a final rinsing step in which the laundry is treated by means of a rinse additive. An additive supply step is also included, where water is introduced into the tub together with the additive. Before the additive supply step, in a saturation step, the laundry is provided with a saturation amount of water for saturating said laundry.

11 Claims, 13 Drawing Sheets

(56) References Cited

U.S. PATENT DOCUMENTS

| | | | | |
|---|---|---|---|---|
| 2005/0183470 | A1* | 8/2005 | Kim | D06F 37/42 68/12.03 |
| 2006/0010611 | A1* | 1/2006 | Snow | D06F 33/02 8/158 |
| 2008/0172804 | A1* | 7/2008 | Vanhazebrouck | D06F 33/00 8/158 |
| 2008/0229517 | A1* | 9/2008 | Amarillas | D06F 35/005 8/159 |
| 2009/0322195 | A1* | 12/2009 | Joerger | D06F 39/02 312/334.1 |
| 2010/0011514 | A1* | 1/2010 | Park | D06F 33/00 8/159 |
| 2010/0024490 | A1* | 2/2010 | Nieh | D06F 33/02 68/12.02 |
| 2012/0077725 | A1* | 3/2012 | Wang | C11D 3/227 510/285 |
| 2013/0081431 | A1* | 4/2013 | Hill | D06F 39/083 68/12.05 |

* cited by examiner

METHOD FOR TREATING LAUNDRY IN A LAUNDRY WASHING MACHINE AND LAUNDRY WASHING MACHINE

FIELD OF THE INVENTION

The present invention concerns the field of laundry treating techniques. In particular, the present invention refers to a method for treating laundry in a laundry washing machine capable of performing a more efficient treatment of the laundry with a fabric softener.

BACKGROUND ART

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread.

In the present description the term "laundry washing machine" will refer to both simple laundry washing machines and laundry washing-drying machines. Laundry washing machines generally comprise an external casing provided with a washing tub which contains a rotatable perforated drum where the laundry is placed. A loading/unloading door ensures access to the drum. Laundry washing machines typically comprise a water supply unit and a products supply unit, preferably a drawer, for the introduction of water and washing/rinsing products (i.e. detergent, softener, rinse conditioner, etc.) into the tub. Known laundry washing machines are also provided with water draining devices that may operate during different phases of the washing program to drain the dirty water.

According to the known technique, a complete treating program typically includes different phases during which the laundry to be washed is subjected to adequate treatments. A treating cycle usually comprises a main washing phase during which the laundry is treated by means of water and a detergent. The water is typically heated to a predetermined temperature based on the washing program selected by the user. It is also possible that hot water is introduced into the tub from the hot water mains. During the main washing phase the drum is rotated, so as to apply also a mechanical cleaning action on the laundry. At the end of the main washing phase the drum is typically rotated at high rotational speed, so in such a way that dirty washing liquid (i.e. water mixed with detergent) is extracted from the laundry, and this dirty washing liquid is drained to the outside by the water draining devices.

A successive step of the cycle typically comprises a rinsing phase which usually comprises one or more rinsing cycles/steps. In a rinsing cycle, clean rinse water may be first added to the laundry. The rinse water is absorbed by the laundry and the rinse water removes from the laundry detergent and/or dirty water not previously removed by washing liquid in the main washing cycle. The drum is then rotated to extract water and dirty water/detergent from the laundry: the dirty water extracted is drained from the tub to the outside by the water draining devices.

After a rinsing phase, one or more final spinning phases may be provided for the extraction of the residual water contained in the wet laundry. The water extracted during the spinning phase is drained towards the outside by means of the water draining devices (during or after the spinning phase).

According to the known technique, in the rinse phase a dose of rinse additive is added to the laundry. Rinse additives may comprise, for example, fabric softeners, fabric conditioners, waterproofing agents, fabric enhancers, rinse sanitization additives, chlorine-based additives, i.e. products suitable to be added in one of the rinsing cycles. The rinse additive is typically added in the last rinsing cycle, in particular when the rinse additive is a fabric softener. In different embodiments, nevertheless, the rinse additive may not be added in the last rinsing cycle but before. For example, the rinse additive is typically added in the first rinsing cycle when the rinse additive is a chlorine-based additive.

Use of rinse additives contributes to reach special features for the laundry, such as softness, long lasting perfume, waterproofing, sanitization, etc. Rinse additives may be used in particular form, typically and preferably in liquid form, but also as a gel, or powder, or tabs, or liquid-tabs. Typically, rinse additives are delivered from the products supply unit (drawer) into the tub. The rinse additive falls to the bottom region of the tub and from there enters the perforated rotatable washing drum.

However, the washing programs of the known art pose some drawbacks. A drawback posed by the washing programs of the known art lies in that the direct introduction of rinse additives into the drum and onto the fabrics or laundry can lead to an inhomogeneous distribution of the additive, since the additive attaches only to specific parts of the laundry, which prevents the laundry from acquiring the desired properties, for example an overall softness.

SUMMARY OF SELECTED INVENTIVE ASPECTS

An object of the present invention is therefore to overcome drawbacks posed by the known technique.

It is an object of the invention to provide a method for washing laundry in a laundry washing machine that makes it possible to improve the distribution of the rinse additives over the laundry items with respect to the known techniques.

It is a further object of the invention to provide a method for washing laundry in a laundry washing machine that makes it possible to improve the efficiency of the rinse additives on the laundry.

It is a further object of the invention to provide a method for washing laundry in a laundry washing machine that makes it possible to improve the homogeneity of the distribution of rinse additives on the laundry.

It is still another object of the invention to provide a laundry washing machine that allows an improved treatment of laundry with rinse additives.

An aspect invention is based on the consideration that due to the increased quality demands on laundry, it is of great importance that rinsing additives are applied in a homogenous way to the laundry. Only then, their desired effects on the laundry can be realized and enhance the state of the laundry. This is especially true for the application of softener, which should not leave untreated parts of laundry which would lead to a discomforting feel while wearing the clothes.

The applicant has found that a homogenous distribution of a rinse additive can be achieved if the laundry is saturated with water and is in a saturated state when the softener is supplied into the tub. The rinse additive then has more time available to react with the laundry before being absorbed at a specific part of the laundry. The chemical reaction of the rinse additive then proceeds more slowly or progressively compared to the situation when the laundry is not saturated, allowing essentially all parts of the laundry to react with the additive.

Applicant has also recognized that after a high spinning phase, in which the laundry is pressed against the interior of the drum, the laundry still tends to stick to the interior of the drum, offering the rinse additive which enters the drum only a comparably small surface for reaction. When the laundry is provided with water and absorbs water until it is saturated, it gets detached from the interior surface of the drum, providing a larger surface for interactions or reactions with the additive. Providing the laundry with a saturation amount of water in this case has two effects which both support a homogenous treatment of the laundry with the rinse additive.

The invention therefore in a first aspect relates to a method for treating laundry in a laundry washing machine of the type comprising:

- a rotatable perforated washing drum provided with holes and adapted to receive laundry;
- a washing tub external to the washing drum;
- a water supply circuit comprising at least one supply valve to supply fresh water into the washing tub;
- a detergent supplier to supply detergent into the washing tub;
- a rinse additive supplier to supply at least one rinse additive into the washing tub;

the method comprising

- at least one washing phase during which the laundry is washed with introduction of water and the detergent into the washing tub and tumbled by rotation of the washing drum;
- at least one successive draining phase for draining liquid from the washing tub and following the draining phase at least one rinsing step in which the laundry is soaked with water; and
- a final rinsing step in which the laundry is treated by means of the rinse additive, and including an additive supply step, wherein water is introduced into the tub together with the additive, wherein before the additive supply step, in a saturation step the laundry is provided with a saturation amount of water for saturating the laundry.

Preferred embodiments of the invention are described in relation to the dependent claims and the description of the enclosed drawings.

The present invention has proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry). In the present description, therefore, the term "laundry washing machine" refers to both simple laundry washing machines and laundry washing-drying machines.

Preferably, when water is introduced into the tub together with the additive, water drags the additive from the additive dispenser to the tub, or water flushes the additive out of the additive dispenser.

In the context of this patent application, the term "saturated laundry" means that the laundry is not able to absorb further water. For laundry located in the tub, this means that when laundry is saturated, water drips into the bottom of the tub, resulting in free water in the bottom of the tub.

The rinse additive is preferably a fabric softener, most preferably a cationic fabric softener, including cationic actives and/or cationic surfactant. Preferably, the last or final rinsing step is subsequent to at least one preceding rinsing step. This means that there is at least one rinsing step in which the laundry is soaked water without the introduction of the rinse additive. Only in the final rinsing step, additive and water are introduced together into the tub.

In a preferred embodiment, the saturation step comprises at least one of the following:

(1) extracting water from the laundry by rotating the drum at high revolving speed and draining the extracted water from the tub, thereafter introducing clean or fresh water into the tub;

(2) before the last rinsing cycle, the water from the previous rinsing step is not drained or water is partially drained so that rinsing water is kept into the tub in order to maintain the laundry saturated;

(3) rotating the drum at low revolving speed so as not to extract water from the laundry and draining the water not absorbed by the laundry from the tub in order to maintain the laundry saturated.

In variant (1), the term "fresh water" denotes water without an admixture or addition of additive. The water can be introduced to the tub through a dedicated fresh water duct or channel or guided through a compartment of a drawer or dispenser for a detergent, whereby this compartment during previous operations has been essentially fully emptied.

In variant (2) or (3), the saturation amount of water is preferably provided to the laundry in a rinsing step which, advantageously essentially immediately, precedes the last rinsing step, this preceding rinsing step therefore comprises the saturation step.

The term "high revolving speed" refers to a revolving or spinning speed in which during spinning of the drum water is extracted from the laundry, i.e., the amount of water absorbed by the laundry decreases. The term "low revolving speed" refers to a revolving or spinning speed in which water is not extracted from the laundry, i.e. the amount of absorbed water essentially remains the same/stays constant. These two regimes usually have no clear-cut border and can depend on the kind of laundry, drum size etc. Preferably for top-loading or front-loading horizontal-axis washing machines, revolving speeds equal to or larger than 100 rpm (revolutions per minute) are considered to be high revolving or spinning speeds, while revolving speeds below 100 rpm are considered to be low revolving or spinning speeds. The method according to the invention can also be employed for vertical axis machines, whereby the corresponding high and low revolving speeds are preferably chosen dependent on the specific configuration and size of the vertically aligned tub.

Embodiments of the invention that do not comprise a high spinning phase in the rinse cycle which precedes the introduction of the rinse additive into the tub are therefore preferably performed with several rinse cycles or rinsing steps, preferably four or more, in order to remove dirt water from the laundry before the additive is supplied into the tub.

Preferably, the saturation amount of water is determined based on the water loaded during the washing phase. This amount is large enough to allow a reliable saturation of laundry before the additive is introduced.

Advantageously, the saturation amount of water is determined based on at least one parameter of the appliance which is detected during the washing phase. The at least one parameter can, for instance, be one or more from the group of signals: signal of weight sensor, water level, drive of motor, energy consumption of motor, motor current. This signal is preferably used to estimate the weight and/or amount of the laundry in the drum and/or its capacity to absorb water. These estimated data can then be used to estimate the size of the saturation amount of water. Preferably a scheme or lookup table is provided in a persistent storage of the laundry washing machine that allows obtaining a corresponding saturation amount of water for the determined laundry weight/load.

In a preferred embodiment, in a persistent storage of the appliance, a scheme or table values for the saturation amount are stored for the corresponding value of the at least one parameter. Alternatively or in combination thereto, the saturation amount can be computed as a function of the value of the at least one determined parameter. In another preferred embodiment, the saturation amount corresponds to a predetermined amount that suffices to saturate said laundry. This amount can be chosen by experiment to allow a fully saturated state of laundry.

The additive supply step preferably includes a circulation step wherein the water and the additive in said tub are circulated from a lower part of said tub to another lower part of said tub so as to mix the water and additive. By performing this circulation step, the dissolution of the softener is improved. The circulation step combines with the described saturation step, leading to a synergistic effect of distributing the softener homogeneously among the laundry. The circulation and the resulting improved dissolution of the softener are especially useful for concentrated or super-concentrated rinse additives, such as concentrated or super-concentrated softeners. If no complete dissolution takes place, as a consequence, there will be some laundry items subjected to a high concentration of the additives. Laundry subject to different concentrations of an additive can cause stains or halos and reduce the overall performance of the laundry treatment appliance. The washed laundry, therefore, may not have the requested homogenous special features, i.e. softness, perfume, waterproofing, sanitization, etc.

During this circulation, advantageously at least a portion of the recirculating water and additive do not enter the washing drum.

In a preferred embodiment, during the last rinsing step or cycle, after providing the saturation amount of water in said tub, the water and additive in the tub are circulated from a lower part of the tub to a higher part of the tub for introducing the additive into the drum and treating the laundry. In case that a circulation of water and additive from a lower part of the tub to another lower part of the tub is performed as described above, an admixture of water and additive is circulated.

The number of rinse steps and/or the saturation step are advantageously performed in dependence of at least one rinsing parameter set in said laundry appliance.

Preferably, the at least one rinsing parameter is selectable by a user.

In a second aspect, the invention relates to a laundry washing machine, adapted to perform a method according to one of the preceding claims.

In a preferred embodiment of the invention, the laundry washing machine according comprises:

a washing tub external to a rotatable washing drum adapted to receive laundry;

a water supply circuit comprising at least one supply valve to supply fresh water into the washing tub;

a detergent supplier to supply detergent into the washing tub;

a rinse additive supplier to supply at least one rinse additive into the washing tub;

a liquid outlet circuit suitable for withdrawing liquid from the washing tub and to convey such a liquid to the outside;

a control unit for conducting a method comprising at least one washing phase during which the laundry is washed with introduction of water and the detergent into the washing tub and tumbled by rotation of the washing drum;

at least one successive draining phase for draining liquid from the washing tub and following the draining phase at least one rinsing step in which the laundry is soaked with water; and a final rinsing step in which the laundry is treated by means of the rinse additive, and including an additive supply step, wherein water is introduced into the tub together with the additive, wherein before the additive supply step, in a saturation step the laundry is provided with a saturation amount of water for saturating the laundry.

The saturation amount of water is provided in such a way that when the additive supply step commences or begins, the laundry is in a saturated state. The additive then encounters saturated laundry and therefore does not adhere or attach quickly to laundry parts not being saturated, leading to an inhomogeneous and disadvantageous distribution of the additive upon the laundry.

Advantageously, during the saturation step, the control unit performs at least one of the following steps:

(1) extracting water from the laundry by rotating the drum at high revolving speed and draining the extracted water from the tub, thereafter introducing fresh water into the tub;

(2) before the last rinsing cycle, the water from the previous rinsing step is not drained or water is partially drained so that rinsing water is kept in the tub in order to maintain the laundry saturated;

(3) rotating the drum at low revolving speed so as not to extract water from the laundry and draining the water not absorbed by the laundry from the tub in order to maintain the laundry saturated.

Preferably, the laundry washing machine comprises a first recirculation circuit suitable for withdrawing liquid from a lower part of said tub and to re-admit such a liquid into a lower part of the tub, the first recirculation circuit comprising a first recirculation pump suitable for forcing liquid inside the first recirculation circuit, whereby the control unit performs the step of:

circulating the liquid in the first circulation circuit by activating the first recirculation pump for a specified time.

Preferably, this circulation is conducted during and/or after the additive supply step. As described above with respect to the method, this recirculation circuit mainly serves to improve the dissolution of the additive in water, which is especially advantageous for highly concentrated additives.

Preferably, the laundry washing machine comprises a second circulation circuit suitable for withdrawing liquid from a lower part of the washing tub and to re-admit such a liquid into a higher part of the tub, the second recirculation circuit comprising a second recirculation pump suitable for forcing liquid inside the second recirculation circuit; whereby the control unit performs the step of:

circulating the liquid in the second circulation circuit by activating the second recirculation pump for a specified time.

Preferably, this circulation is conducted during and/or after the saturation step. One main purpose of the second circulation circuit is to effectively wet the laundry, which is preferably sprayed onto the laundry from the higher part of the tub. In this way, the amount of water necessary for essentially fully wetting the laundry is reduced compared to laundry washing machines without such a circulation circuit, which have to provide a higher water level for assuring the wetting of the laundry.

The second recirculation serves to enhance wetting of the laundry by taking water from a lower part of the tub and dropping or spraying it from a higher part of the tub onto the laundry. It additionally serves to distribute the rinse additive, especially softener, among the laundry, wherein the additive can get in contact with the laundry not only in a bottom region of the tub but also from above. The first recirculation circuit serves to mix the components of the liquid in the tub, whereby the homogeneity of the mixture of water and additive can be improved. The circulation of liquid in the tub via the first and second recirculation circuits can be performed subsequently, simultaneously, or partly simultaneously.

In a preferred embodiment, the laundry washing machine comprises a rinse select part or user element which allows a user to select the number of rinsing steps and/or at least one parameter related to at least one of the rinsing steps. The rinse select part advantageously allows inputting at least one parameter related to at least one additional rinse cycle or step and/or the number of additional rinse cycles or steps. Preferably, the method comprises a first rinse cycle, zero or more intermediate rinse cycles, zero or more additional rinse cycles, and a final rinse cycle which comprises the additive supply step.

Preferably the saturation step can be selected with the user element/rinse select part. The selection of the saturation step comprises as a first alternative that an extra action is performed by the laundry washing machine which would not take place if the saturation step has not been selected. This extra action is preferably loading the tub with a saturation amount of water that leads to a saturated state of the laundry. In a second alternative, this selection leads to an omission and/or change of steps which would otherwise be performed. Possible omissions/alterations are: a high spinning phase can be omitted or replaced by a low spinning phase. A draining phase can be performed as to only partially drain water from the tub, to essentially only drain free water from the tub, or be completely omitted. In a general sense, steps are omitted and/or changed in such a way that before the additive supply step is performed, the laundry is in a saturated state.

The rinse select part is advantageously provided as a button provided on a user interface/front panel of the laundry washing machine. The term "button" preferably denotes any element or combinations thereof of the group: touch button, rotating knob, capacitive element, resistive element, and touch screen.

The advantages of the invention are especially as follows. The method described allows a homogenous distribution of laundry additives onto the laundry, leading to a laundry treatment with high quality. The overall performance of the laundry treatment routine is improved. A special cycle for the treatment of the laundry is provided. Due to the enhanced treatment during the rinsing phase, undesired stains or halos on the laundry are reliably avoided. By providing a user element for selecting the numbers and/or parameters of rinsing cycles, the user is given a choice for an "extra soft" laundry treatment program and thereby enriches the spectrum of available laundry treatment routines.

BRIEF DESCRIPTION OF THE DRAWINGS

Further characteristics and advantages of the present invention will be highlighted in greater detail in the following detailed description of preferred embodiments of the invention, provided with reference to the enclosed drawings and given as an indication and not for limiting purposes.

In particular, the attached drawings are included to provide a further understanding of the invention and are incorporated in and constitute a part of this specification. The drawings together with the description explain the principles of the invention. In the drawings, corresponding characteristics and/or components are identified by the same reference numbers. In these drawings.

DETAILED DESCRIPTION EXAMPLE EMBODIMENTS

Figure 1:
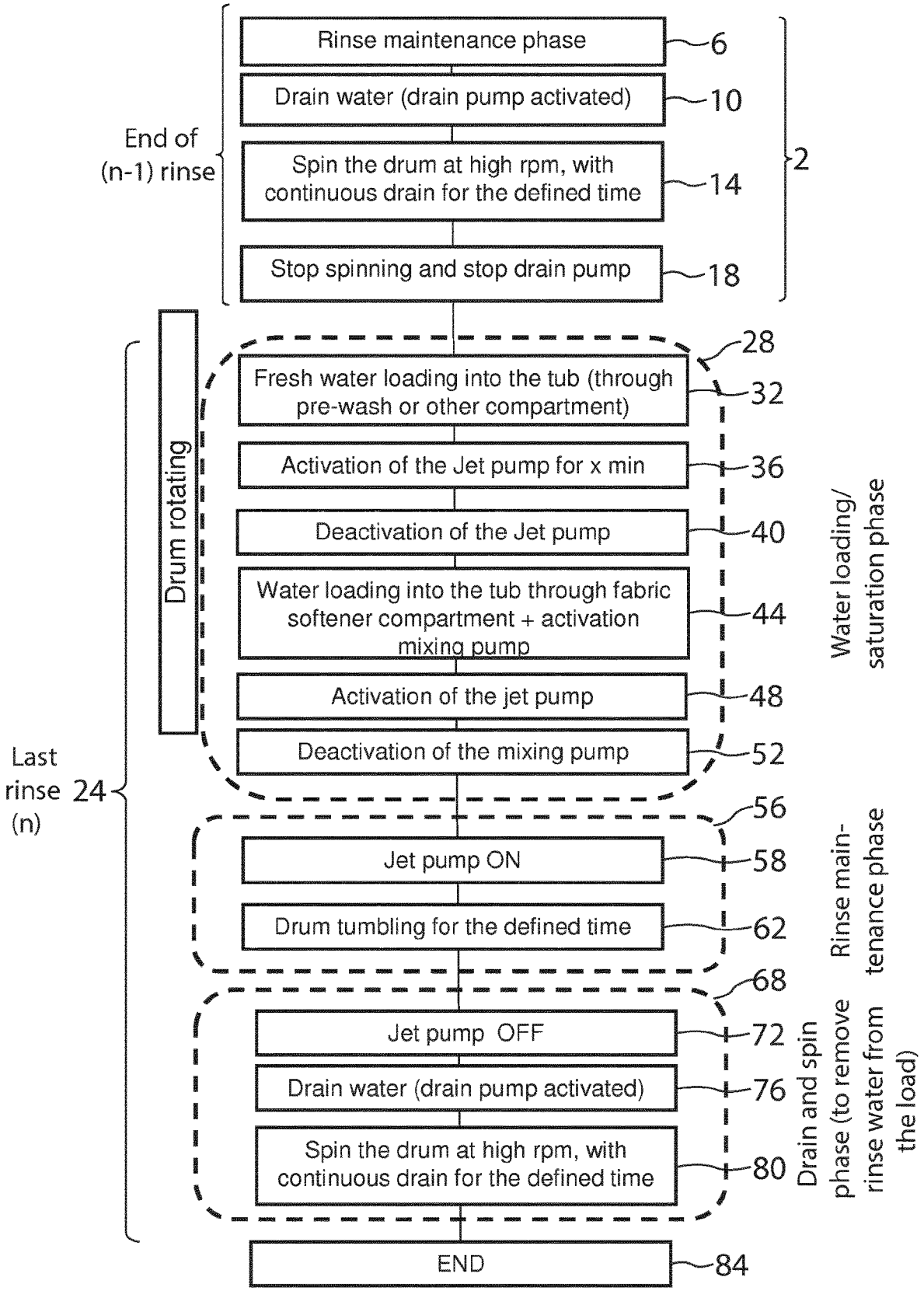
FIG. 1 shows a flow diagram of a method for treating laundry in a laundry washing machine in a first preferred embodiment.

In FIG. 1, a method for treating laundry in a preferred embodiment is displayed as a flow chart. It is conducted in a laundry washing machine with

- a rotatable perforated washing drum provided with holes and adapted to receive laundry;

a washing tub external to the washing drum;

a water supply circuit comprising at least one supply valve to supply fresh water into the washing tub;

a detergent supplier to supply detergent into the washing tub;

a rinse additive supplier to supply at least one rinse additive into the washing tub.

The laundry treatment machine further comprises a first recirculation circuit suitable for withdrawing liquid from a lower part of the tub and to re-admit such a liquid into a lower part of the tub. The first recirculation circuit comprises a first recirculation pump, henceforth also denoted as "mixing pump" suitable for forcing liquid inside the first recirculation circuit. This first recirculation circuit serves to enhance the dissolution of a rinse additive. During a circulation of the liquid in the first recirculation circuit, the dissolution of the additive in the liquid is improved.

It further comprises a second circulation circuit suitable for withdrawing liquid from a lower part of the tub and to re-admit such a liquid into a higher part of the tub. The second recirculation circuit comprises a second recirculation pump, henceforth also denoted as "jet pump", suitable for forcing liquid inside the second recirculation circuit. This circulation circuit allows wetting the laundry with a reduced amount of water since the laundry is wetted not only in the region of the bottom of the tub, but water is also reaching the laundry on an upper side. Preferably, the water is sprayed on the laundry through a nozzle located in the higher region of the tub. While the laundry is being moved or tumbled in the drum, a homogenous and complete wetting can be achieved with a relatively low water level in the tub. Moreover, the distribution of an additive upon the laundry is enhanced since the additive can get in contact with the laundry also by dripping down on the laundry.

This circulation has two important effects. On the one hand, it reduces the necessary consumption of water for wetting the laundry, since the laundry is wetted also from above. Therefore, the water level in the tub does not need to be as high as in cases where a jet pump is not available. Secondly, due to the better distribution of water, the time of this wetting phase can be reduced.

A laundry treatment machine which is especially suited for conducting the method described in connection with FIG. 1 is described below in connection with FIGS. 8, 9, and 10.

Actions which can precede the presented method and are not shown in the FIGs preferably comprise that the user loads the drum with the laundry to be washed. The user fills compartments of a detergent supplier, which is preferably built as a drawer, with products needed for the treatment of the laundry, preferably at least one detergent and in any case one rinse additive, which for the following will be assumed to be a fabric softener. Alternatively, the detergent is provided in a tank and automatically be delivered into a drawer compartment and/or supplied into the tub by a dedicated pump which is controlled and/or operated by the control unit of the laundry washing machine. Similarly, the rinse additive can be provided in a tank and automatically be delivered into a drawer compartment and/or supplied into the tub by a dedicated pump which is controlled and/or operated by the control unit of the laundry washing machine.

The user selects the desired washing program, preferably on a user interface of the laundry washing machine. The laundry washing machine then performs optionally a pre-wash routine and then a main washing cycle. During the main washing cycle the laundry is washed with introduction of water and detergent into the washing tub and tumbled by rotation of the washing drum. During the main washing cycle, the water and detergent are preferably heated at a proper temperature by means of a heating device. At the end of the main washing cycle, the dirty washing liquid is advantageously drained to the outside of the machine by activating a drain pump of a water outlet circuit.

The main washing cycle is followed by at least two rinsing cycles. In a rinsing cycle, clean rinse water is added to the laundry, as to be absorbed by the laundry. The clean water removes from the laundry the residual detergent and/or remaining dirt particles of the main washing cycle. The drum is then advantageously rotated to extract dirty water from the laundry. The dirty water is then drained to the outside of the laundry washing machine preferably by activating the drain pump.

The method steps indicated by a curly brace 2 correspond to the end of the second last rinse phase. When the method comprises a total of n rinse phases, the second last rinse phase is the n−1 rinse phase.

In FIG. 1, a step 6 corresponds to a rinse maintenance phase. In this phase, the laundry is in a state in which it has absorbed water and is saturated with water. Preferably, during this phase, the drum is performing a tumbling motion, which means that the drum is rotated at such a rotational rate or frequency or revolving speed that laundry is tumbling within the drum. In a step 10, the drain pump is activated, and water is drained from the tub. In a step 14, for a defined time, the drum is revolved at a high revolving speed, while the drain pump is still active. In that way, during this step, water is continuously extracted from the laundry and also removed from the tub. A high revolving speed means that water is extracted from the laundry, which essentially means that the centrifugal force acting on the water is large enough that water is leaving the laundry and squeezed out of the laundry and moving to the periphery of the drum, from where it is dripping down into the tub. In contrast, a low revolving speed implies a centrifugal force low enough such that water is essentially staying within the laundry, and no significant amount of water is leaving the laundry. Given as an example or indication and not for limiting purposes, high revolving speeds are preferably considered to have more or equal to 100 rpm, while low revolving speeds have less than 100 rpm. In the described step 14, preferably the drum spin is performed at approximately 1000 rpm. In a step 18, the spinning of the drum is stopped and the drain pump is deactivated. The laundry is now in a state in which it is able to absorb water.

The method steps enclosed by a curly brace 24 correspond to the final rinse cycle or phase. The steps enclosed by a dashed contour 28 correspond to a phase during which water is loaded. These steps are performed in a target-oriented approach to ensure that the laundry is in a saturated state when water together with at least one additive, which in the present preferred embodiment is a fabric softener, are loaded into the tub. In this way, the application of the softener is improved and it can homogeneously distribute among the laundry. With the water having been extracted from the laundry in step 14, water is now loaded and the laundry wetted in order to obtain a saturated state of the laundry.

While in the current embodiment the rinse additive is fabric softener, especially a cationic fabric softener, the laundry may be treated alternatively or in addition with a different rinse additive, such as a fabric conditioner, a waterproofing agent, a fabric enhancer, a rinse sanitization additive, a chlorine-based additive, opportunely disposed inside a dedicated compartment of the drawer of the laundry washing machine.

In a step 32, fresh water is loaded into the tub through a pre-wash or another compartment which at this stage of the washing procedure has been completely emptied. In other words, no detergent or washing agent is introduced into the tub at this stage. A pre-wash compartment is typically filled with a detergent for cloths which are especially dirty. It is flushed by water to transport the pre-wash detergent into the tub before the main washing phase and therefore is essentially empty in step 32. Similarly, a compartment related to the main washing phase has already been emptied at the time when step 32 is conducted. The criterion for the use of such a compartment is that at this stage it has been essentially fully emptied. In step 32, also a bypass-line can be used which essentially directly transports fresh water from the water mains into the tub. The term "fresh water" denotes clean water, i.e. water without additions such as detergent and/or rinse additive.

Step 32 is a saturation step in which the amount of fresh water is chosen to assure that the laundry is saturated before the following steps are executed. This step is executed since during the high-spinning phase in step 14, the water has been extracted from the laundry and leaves the laundry only with residual water. In the present embodiment, first a fixed saturation amount of water of approx. 7-9 liters is introduced into the tub which suffices for a typically and moderately loaded drum of a moderate laundry weight, in the present case, 3 kg to saturate the laundry. A saturated state of the laundry denotes a state in which the laundry is no longer able to absorb water.

Preferably, during the washing/wetting phase, the current weight of the laundry load is detected. This is preferably determined based on at least one parameter of the appliance which is detected during the washing phase. The at least one parameter can, for instance, be one or more of the signals: signal of weight sensor, water level, drive of motor, energy consumption of motor, motor current.

If during the washing/wetting phase, a laundry amount is detected, preferably as described above, which exceeds the moderate laundry weight, more water can be added to ensure the saturation of the laundry. For instance, in a persistent storage of the laundry washing machine, a table can be stored which contains this additional amount needed as a function of the weight that exceeds the moderate laundry weight. In an alternative design, such a table can contain absolute values of the full laundry weight and corresponding saturation amounts of water.

Alternatively, the saturation amount of water can be chosen to be large enough, for instance ca. 15 liters, to reliably lead to a saturation of a fully loaded drum, which typically comprises a laundry weight of 8-9 kg. For smaller laundry loads, a saturation or oversaturation of the laundry is achieved. This procedure assures that for any laundry load, the laundry will be saturated with water before the additive supply step (see below).

In another preferred embodiment, the water loading phase is preferably performed with a plurality of successive partial water loading steps while a pressure sensor monitors the water level in the tub. As long as the laundry is not in a saturated state, water gets absorbed by the laundry, leading to significant water level variations. Once the laundry is in a saturated state, the water level does not show significant or strong variations. It is slowly rising, since additional water only contributes to free water in the tub. At this point, when the saturation of the laundry is detected, the water loading is stopped.

The described observation of the water level can be performed during water loading in a washing phase to obtain an estimate for the amount of laundry and/or the quantity of water needed to saturate the laundry. In the saturation step, this amount of water can be applied to the laundry, preferably with a correction taking into account that during the washing phase essentially dry laundry has been saturated with water while in the saturation step, the laundry may still contain some remaining water.

Alternatively, the monitoring or observing of the water level can be performed during water loading in the saturation step, thereby directly observing the moment or time when the laundry has reached a saturated state. Due to the direct observation, this variant allows a very precise loading of water with the result of laundry being in a saturated state.

The above described steps of water loading by utilizing the observation of the water level during the washing phase and/or the saturation step can also be applied to the embodiments described in connection with FIGS. 3, 5, and 7.

In still another embodiment, in a series of tests, this procedure can be used for a calibration of the saturation amount. For various laundry loads, the needed saturation amount can be determined by using the pressure sensor as described. For each laundry load/weight, a corresponding saturation amount can then be related, and a scheme or table can be stored in a persistent storage of the laundry washing machine. When the laundry weight has been determined during the washing phase, the corresponding entry in the table or scheme can be used for the water loading in order to saturate the laundry. For instance, for a laundry load of 6 kg, a water amount of 11/13 liters can be stored.

In a step 36, the jet pump is activated for a defined time, preferably for one to several minutes. In this way, water is sprayed on the laundry, leading to a good distribution of water on the laundry. In a step 40, after the defined time, the jet pump is deactivated again. The laundry is now in a saturated state with a homogenous distribution of water in the laundry.

In a step 44, which is an additive supply step, water is loaded into the tub through the fabric softener compartment, thereby flushing or transporting the softener into the tub and supplying the laundry with the softener. Simultaneously, the mixing pump is activated. In this way, the water together with the softener is circulated and mixed, increasing the homogeneity of this admixture. The amount of water loaded into the tub in step 44 is in the current embodiment in a first loading step 5 liters and after a delay time, preferably 30 seconds, again 5 liters. In this way, it is assured that essentially all softener is transported into the tub. Since the laundry is in a saturated state after steps 32, 36, 40 have been performed, the total of 10 liters which is flushed through the softener compartment does not contribute to the saturation of the laundry and is not necessary for its saturation. In case of an automatic dispenser, a water amount of 1-3, for instance 2, liters can be used to supply the rinse additive into the tub.

The amount of water which is flushed through the softener compartment can be chosen as to deliver all softener into the tub. The amount of softener can for instance be 50 ml. Since the softener/water admixture meets the laundry in a saturated state, its adherence time is reduced compared to the situation where it would meet laundry pieces which are not saturated with water. In this way, the distribution of the softener among the laundry is optimized, and the softener can essentially act on all of the laundry in a homogenized way.

In a step 48, the jet pump 48 is activated, enhancing the distribution of the mixture of softener and water upon the laundry. Preferably, the activation of the jet pump is performed after a defined time or delay, for instance 30 seconds, after the mixing pump has been activated. In this way, the spraying of the water/additive mixture is only stared after a good dissolution of the additive in the water has been achieved.

In a step 52, the mixing pump is deactivated. In the preferred embodiment shown, the mixing pump is running in a time interval during which the jet pump is active. In an alternative embodiment, the mixing pump can be activated, run for a defined time interval and be deactivated. Subsequently, the jet pump is activated, runs for a defined time, and is the deactivated. In this way, first the softener/water is mixed and homogenized by the circulation circuit with the mixing pump, and then subsequently, this homogenized mixture is distributed upon the laundry by circulating it to a higher part of the tub and preferably spraying it unto the laundry. It is also possible to activate the mixing pump after the jet pump has been activated and to deactivate the mixing pump again before the jet pump is deactivated.

The mixing pump drains water from a bottom region of the tub and re-admits it again into essentially the same bottom region which is located in the sump. This region is preferably located in the bottom of the sump in the vicinity or adjacency of the heater.

During steps 32, 36, 40, 44, and 48, the drum is rotating.

The steps corresponding to a rinse maintenance phase are enclosed by a dashed contour 56. In a step 58, the jet pump is active, i.e. it is running. In a step 62, the drum is performing a tumbling motion for a defined time. The term "tumbling motion" denotes rotating the drum with a revolving speed during which the laundry in the drum is tumbling. The laundry pieces are typically tumbling in the drum, are carried upwards until they drop down again.

The steps corresponding to a drain and spin phase are enclosed in a dashed contour 68. This phase aims at extracting rinse water from the laundry load. In a step 72, the jet pump is turned off, which stops the water circulation in the first recirculation circuit. In a step 76, the drain pump is activated and water is drained from the tub. While the water is drained in a step 80, the drum is rotated at high rpm, preferably >100 rpm. This is conducted for a defined time. The method is finished at end 84. The laundry can be extracted from the drum.

Figure 2:
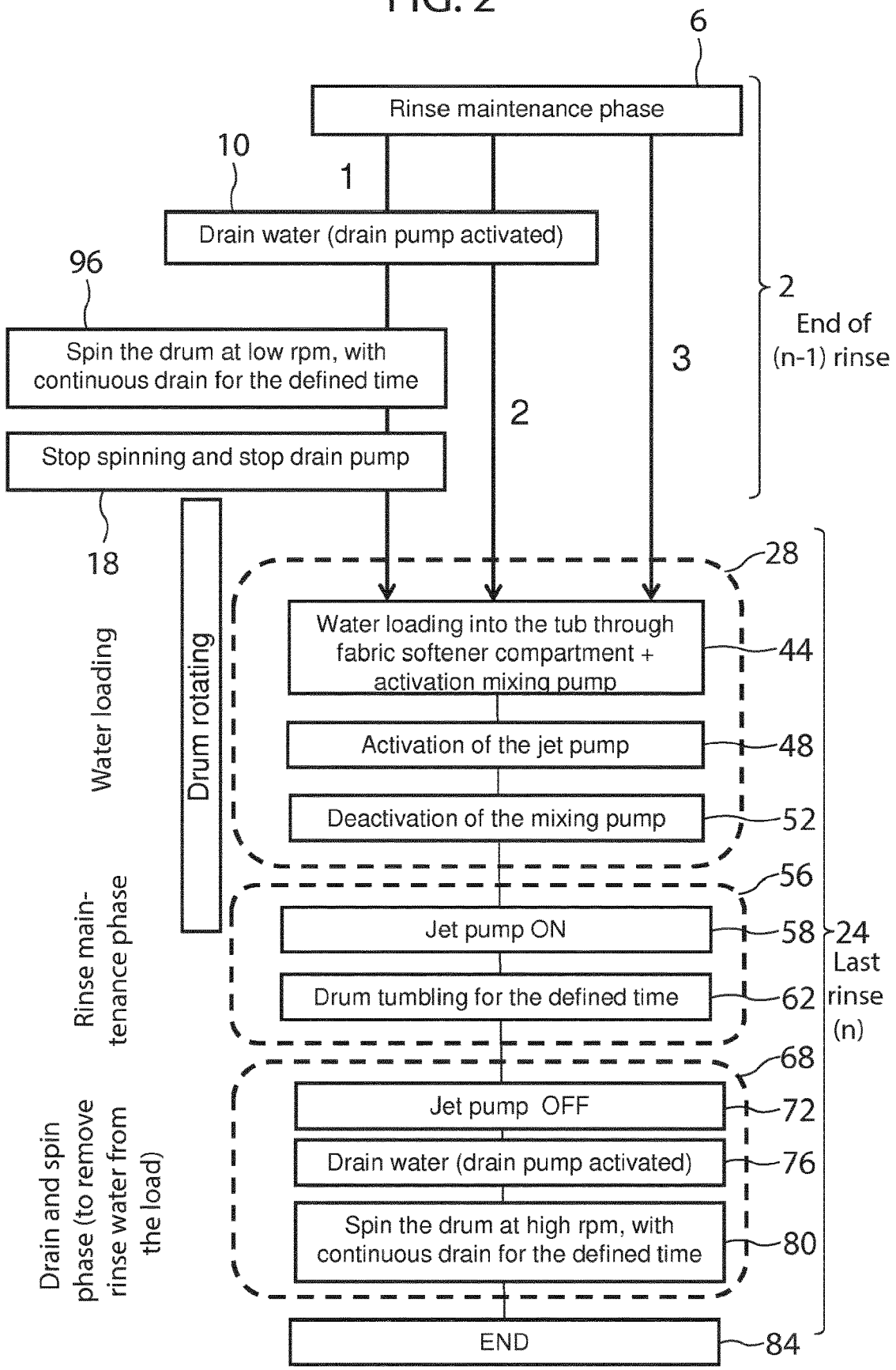
FIG. 2 shows a flow diagram of a method for treating laundry in a laundry washing machine in three further preferred embodiments.

In FIG. 2, three further preferred embodiments are shown which are alterations of the embodiment discussed in connection with FIG. 1. The preferred embodiments shown in FIG. 2 differ from the embodiment discussed in connection with FIG. 1 by the way in which the saturation of the laundry is achieved before water and fabric softener are loaded into the tub in step 44. These three embodiments do not comprise a high spinning phase in the rinse cycle which immediately precedes the introduction of softener in the tub. They are therefore preferably performed with several rinse cycles or rinsing steps, preferably four or more, in order to remove dirt water from the laundry before the additive is supplied into the tub.

In a first of the three embodiments shown in FIG. 2, after a rinse maintenance step 6, in a step 10, the drain pump is activated and water is drained from the tub. In a subsequent step 96, the drum is rotated at low rpm, preferably at around 50 rpm, with continuous drain for a defined time. Due to the low revolving speed of the drum, water that has been absorbed by the laundry previously is essentially not extracted from the laundry. In this way, the laundry, which has become saturated with water in the rinse maintenance phase of step 6, stays in a saturated state. Essentially only the free water in the tub is drained. In a step 18, spinning of the drum is stopped, and the drain pump is stopped or deactivated.

The laundry at this stage is in a saturated state. In a step 44, water is loaded into the tub through the fabric softener compartment and the mixing pump is activated, improving the dissolution of the softener. The softener/water mixture enters the tub and meets the laundry in a saturated state. In a step 48, the jet pump is activated and the softener/water mixture is sprayed on top of the laundry, thereby improving its distribution among the laundry. The mixing pump is deactivated again in a step 52.

During a rinse maintenance phase, in a step 58 the jet pump is active. In a step 62, the drum is performing a tumbling motion for a defined time. The laundry is tumbling while the softener can act on the laundry.

In a subsequent drain and spin phase, of which the steps are framed by a contour 68, the rinse water is removed or extracted from the laundry load. In a step 72, the jet pump is not active. In a step 76, the drain pump is activated and water is drained from the tub. In a step 80, the drum is rotated at a high revolving speed for a defined time. In this step, water is extracted from the laundry due to the centrifugal force. The methods finishes at end 84.

In a second of the three embodiments shown, the rinse maintenance phase in step 6 is followed by step 10, in which the drain pump is activated, and water is drained from the tub. The steps 96 and 18 are not performed, however, and the method jumps from step 10 to step 44. Compared to the embodiment described before, even more water is remaining in the laundry, since there is not even a spinning of the drum at low revolving speed. Also in this case, the laundry is in a saturated state when fresh water and softener are introduced into the tub in step 44. In step 44, water is loaded into the tub through the fabric softener compartment and the mixing pump is activated, improving the dissolution of the softener. The softener/water mixture enters the tub and meets the laundry in a saturated state. In step 48, the jet pump is activated and the softener/water mixture is sprayed on top of the laundry, thereby improving its distribution among the laundry. The mixing pump is deactivated again in step 52.

During a rinse maintenance phase, in step 58 the jet pump is active. In step 62, the drum is performing a tumbling motion for a defined time. The laundry is tumbling while the softener can act on the laundry.

In a subsequent drain and spin phase, of which the steps are framed by a contour 68, the rinse water is removed or extracted from the laundry load. In step 72, the jet pump is not active. In step 76, the drain pump is activated and water is drained from the tub. In step 80, the drum is rotated at a high revolving speed for a defined time. In this step, water is extracted from the laundry due to the centrifugal force. The method finishes at end 84. Since no spinning phase is conducted in this embodiment between steps 10 and 44, advantageously several rinsing cycles or steps are performed in order to assure that the laundry has no remnants of dirt water and detergent.

In a third of the three embodiments, a rinse maintenance phase of step 6 is directly followed by step 44, in which fresh water and softener are loaded into the tub, which means the method jumps from step 6 to step 44. Since no water is drained at all or water is only partially drained, for instance only the free water in the tub, after the step 6, it is assured that the laundry is saturated before step 44.

In step 44, water is loaded into the tub through the fabric softener compartment and the mixing pump is activated, improving the dissolution of the softener. The softener/water mixture enters the tub and meets the laundry in a saturated state. In step 48, the jet pump is activated and the softener/water mixture is sprayed on top of the laundry, thereby improving its distribution among the laundry. The mixing pump is deactivated again in step 52.

During a rinse maintenance phase, in a step 58 the jet pump is active. In a step 62, the drum is performing a tumbling motion for a defined time. The laundry is tumbling while the softener can act on the laundry.

In a subsequent drain and spin phase, of which the steps are framed by a contour 68, the rinse water is removed or extracted from the laundry load. In step 72, the jet pump is not active. In step 76, the drain pump is activated and water is drained from the tub. In step 80, the drum is rotated at a high revolving speed for a defined time. In this step, water is extracted from the laundry due to the centrifugal force. The method finishes at end 84.

Figure 3:
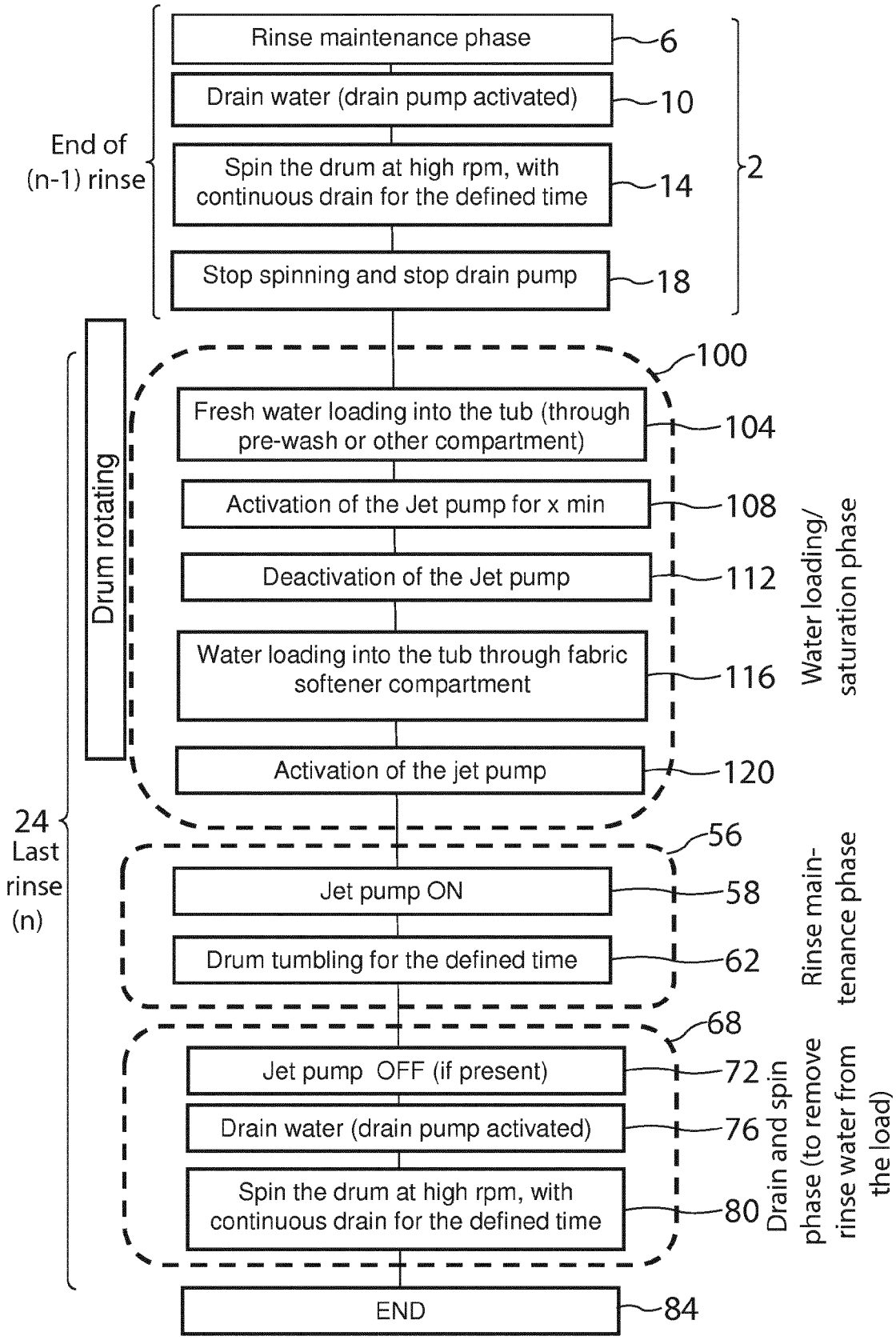
FIG. 3 shows a flow diagram of a method for treating laundry in a laundry washing machine in a further preferred embodiment.

In FIG. 3, a further preferred embodiment is shown which is especially suitable for a laundry washing machine with a jet pump in a second recirculation circuit but without a mixing pump in a first recirculation circuit. It is especially suited to be performed by a laundry washing machine described in connection with FIG. 11.

In step 6 of this embodiment, a rinse maintenance phase is performed. In a step 10, the drain pump is activated, and water is drained from the laundry. In a step 14, the drum is revolved at a high revolving speed, while continuously water is extracted from the laundry and dripping into the tub due to the large centrifugal force. This water is drained from the tub for a defined time. In a step 18, spinning of the drum is stopped and the drain pump is deactivated. The laundry after step 18 is in a state where it can absorb water.

The steps enclosed by a dashed contour 100 correspond to a water loading/saturation phase. In a saturation step 104, fresh water is loaded into the tub. This is preferably done through a pre-wash or another compartment which at this stage of the overall laundry treatment is not filled with any detergent. Alternatively, it can be loaded into the tub by a dedicated fresh water line or by dedicated channel in the drawer. This water loading is performed with a saturation amount of water which is large enough to saturate the laundry in the drum. For a defined time, in step 108, the jet pump is activated for a defined time and deactivated in a subsequent step 112.

In a step 116, water is loaded into the tub through the fabric softener compartment. The softener meets the saturated laundry in the drum. Subsequently, in a step 120, the jet pump is activated.

During a rinse maintenance phase, in step 58 the jet pump is active. In step 62, the drum is performing a tumbling motion for a defined time. The laundry is tumbling while the softener can act on the laundry.

In a subsequent drain and spin phase, of which the steps are framed by a contour 68, the rinse water is removed or extracted from the laundry load. In step 72, the jet pump is not active. In step 76, the drain pump is activated and water is drained from the tub. In step 80, the drum is rotated at a high revolving speed for a defined time. In this step, water is extracted from the laundry due to the centrifugal force. The method finishes at end 84.

Figure 4:
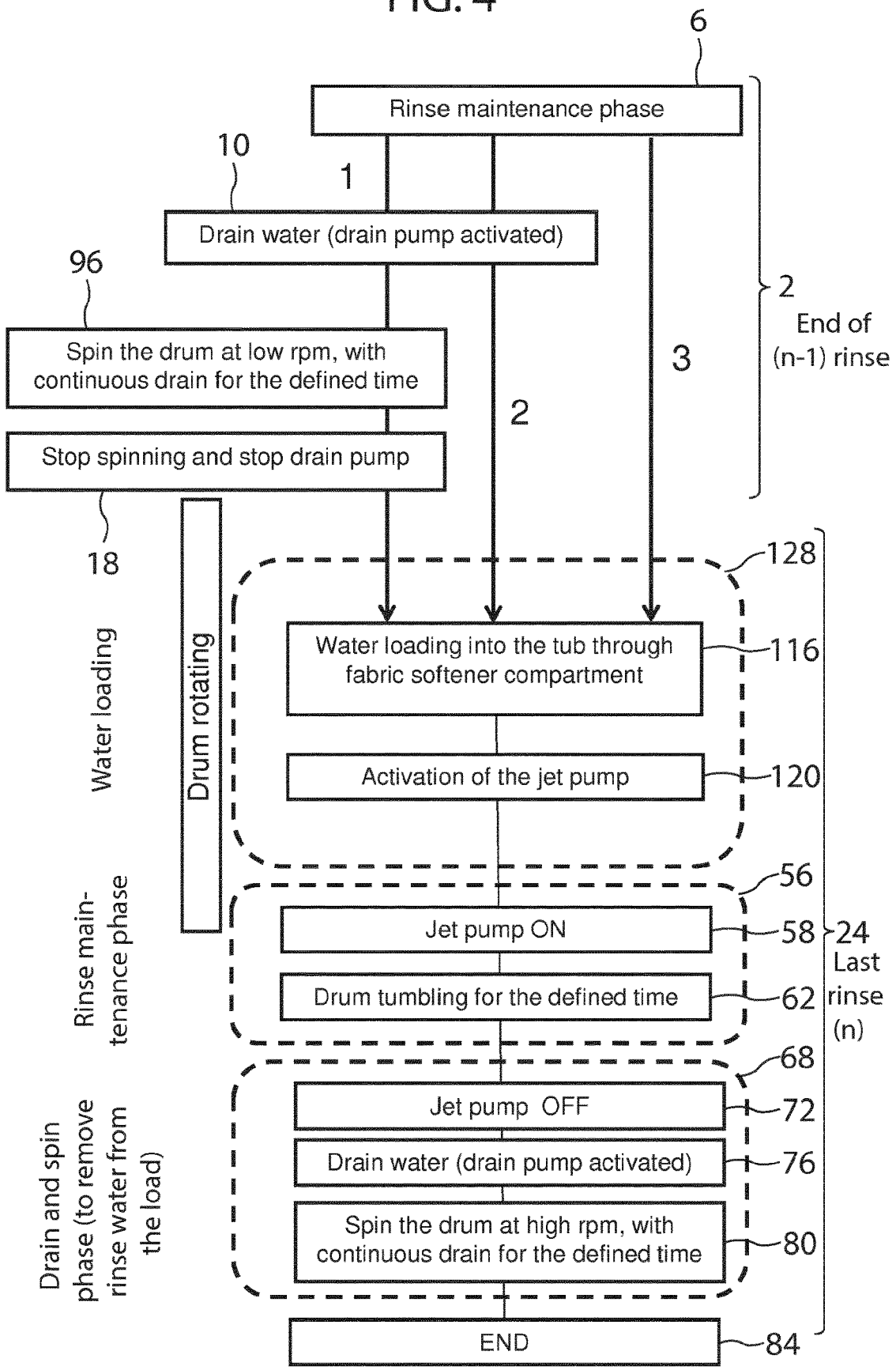
FIG. 4 shows a flow diagram of a method for treating laundry in a laundry washing machine in three further preferred embodiments.

In FIG. 4, three alternative preferred embodiments are shown which are alterations of the embodiment shown in FIG. 3. In a first embodiment, step 6 with the rinse maintenance phase is followed by step 10, in which water is drained from the tub. In step 96, the drum is rotated at low rpm, while continuously water is drained for a defined time. In a subsequent step 18, spinning and draining are stopped.

The steps related to a water loading phase are enclosed by a dashed contour 128. In a step 116, water is loaded into the tub through the fabric softener compartment. The softener meets saturated laundry which hinders the softener to immediately attach to laundry pieces. In a step 120, the jet pump is on or active.

During a rinse maintenance phase, in step 58 the jet pump is active for wetting the laundry and distributing the softener among the laundry. In step 62, the drum is performing a tumbling motion for a defined time. The laundry is tumbling while the softener can act on the laundry.

In a subsequent drain and spin phase, of which the steps are framed by a contour 68, the rinse water is removed or extracted from the laundry load. In step 72, the jet pump is not active. In step 76, the drain pump is activated and water is drained from the tub. In step 80, the drum is rotated at a high revolving speed for a defined time. In this step, water is extracted from the laundry due to the centrifugal force. The method finishes at end 84.

In the second embodiment shown in FIG. 4, the rinse maintenance phase of step 6 is followed by step 10, in which water is drained with the drain pump being active. The steps related to a water loading phase are enclosed by a dashed contour 128. In a step 116 which follows step 10 in this embodiment, water is loaded into the tub through the fabric softener compartment. The method jumps from step 10 to step 116, omitting steps 96, 18. The softener meets saturated laundry which hinders the softener to immediately attach to laundry pieces. The jet pump is preferably not used before this step since there was no high spin phase and the laundry enters step 116 already in a saturated state and has already absorbed water. In a step 120, the jet pump is on or active.

During a rinse maintenance phase, in step 58 the jet pump is active. In step 62, the drum is performing a tumbling motion for a defined time. The laundry is tumbling while the softener can act on the laundry.

In a subsequent drain and spin phase, of which the steps are framed by a contour 68, the rinse water is removed or extracted from the laundry load. In step 72, the jet pump is not active. In step 76, the drain pump is activated and water is drained from the tub. In step 80, the drum is rotated at a high revolving speed for a defined time. In this step, water is extracted from the laundry due to the centrifugal force. The method finishes at end 84.

The method according to the third embodiment shown is performed as in the second embodiment with the only exception that step 10 is omitted. Therefore, step 6 is followed by step 116, and draining of the water in between these steps is not performed. The method jumps from step 6 to step 116. In this way, even more water is present as absorbed water in the laundry and free water in the tub compared to the second embodiment.

Figure 5:
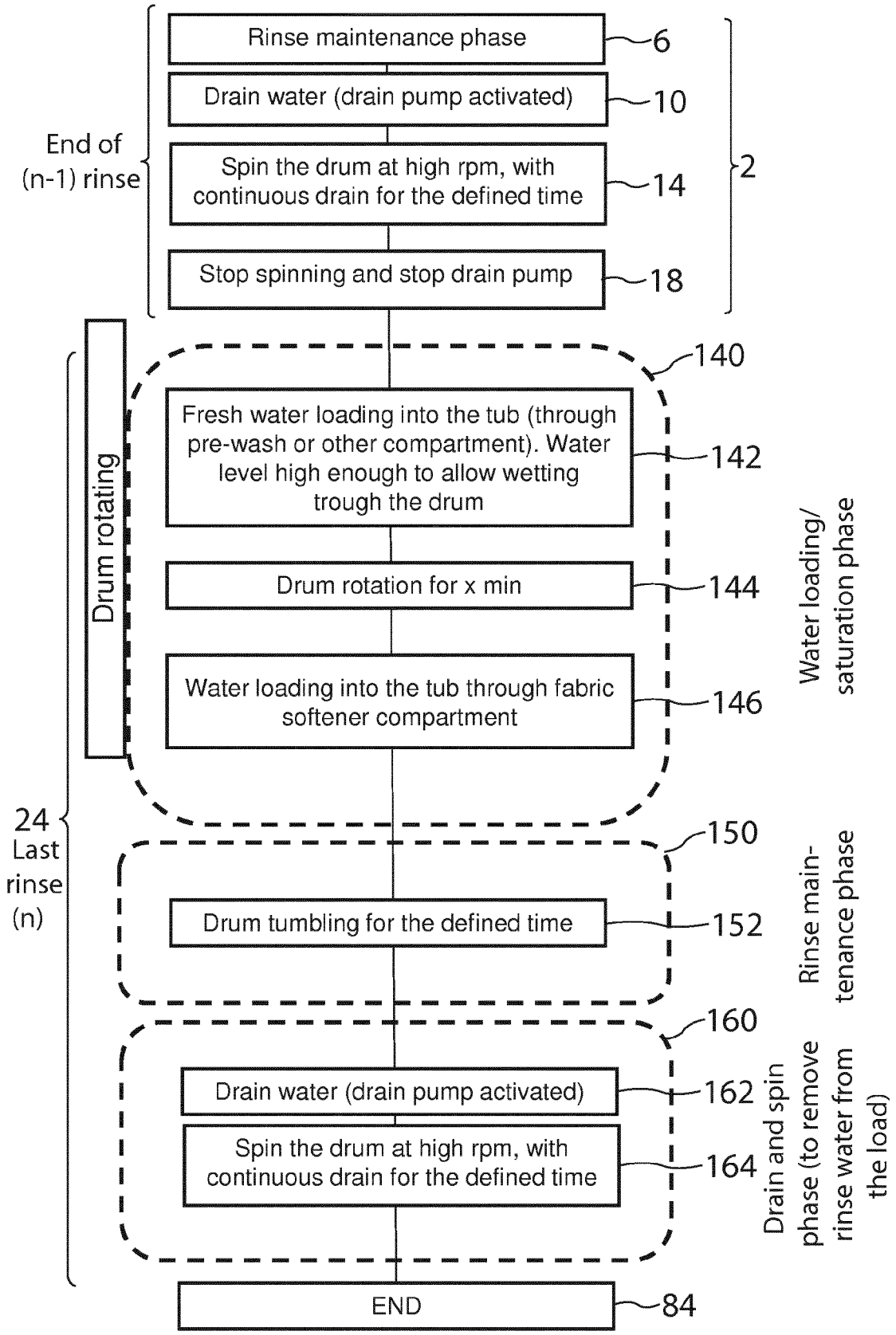
FIG. 5 shows a flow diagram of a method for treating laundry in a laundry washing machine in still another preferred embodiment.
Figure 12:
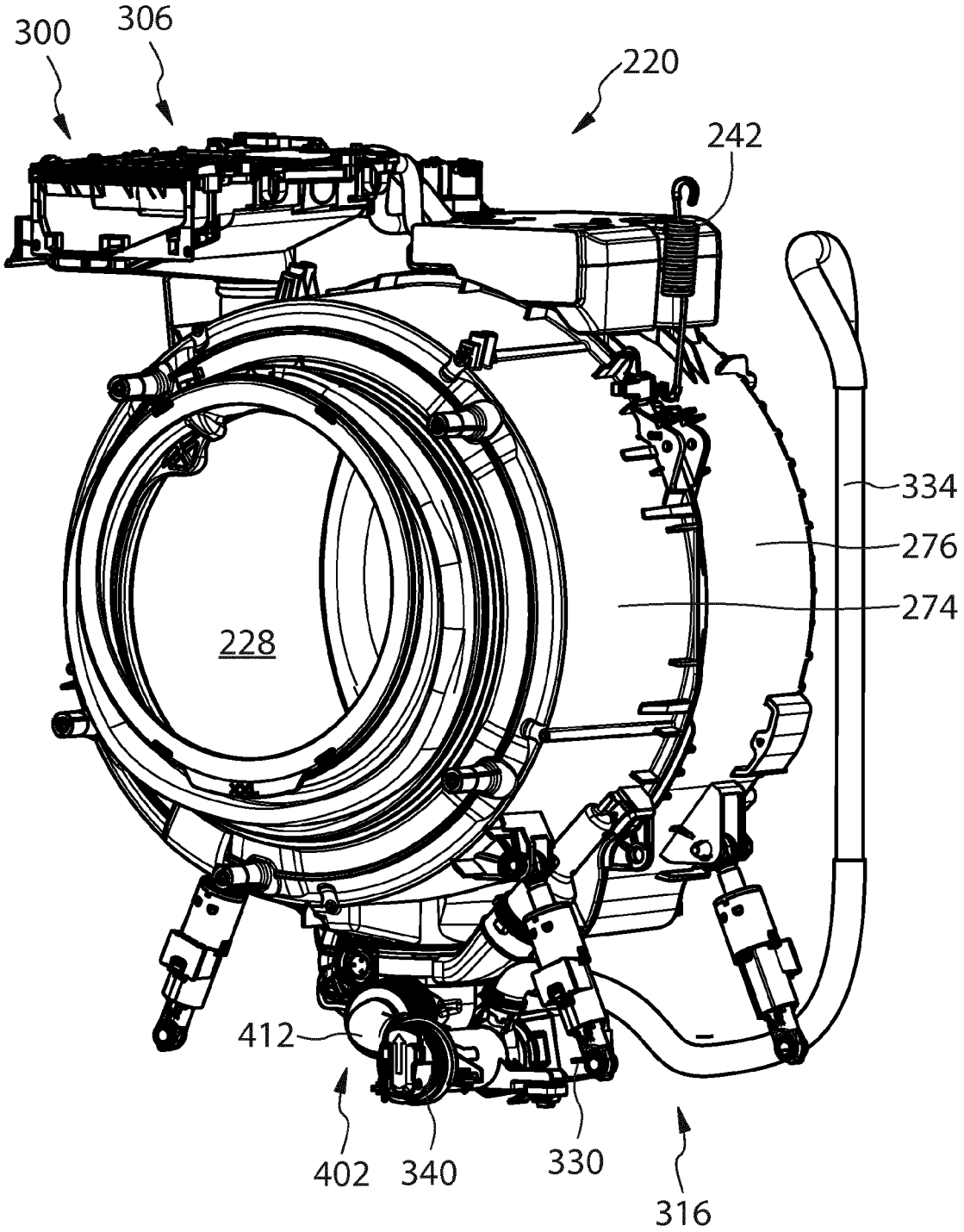
FIG. 12 shows still another preferred embodiment of a front-loading washing machine in a perspective view with the casing removed.
Figure 13:
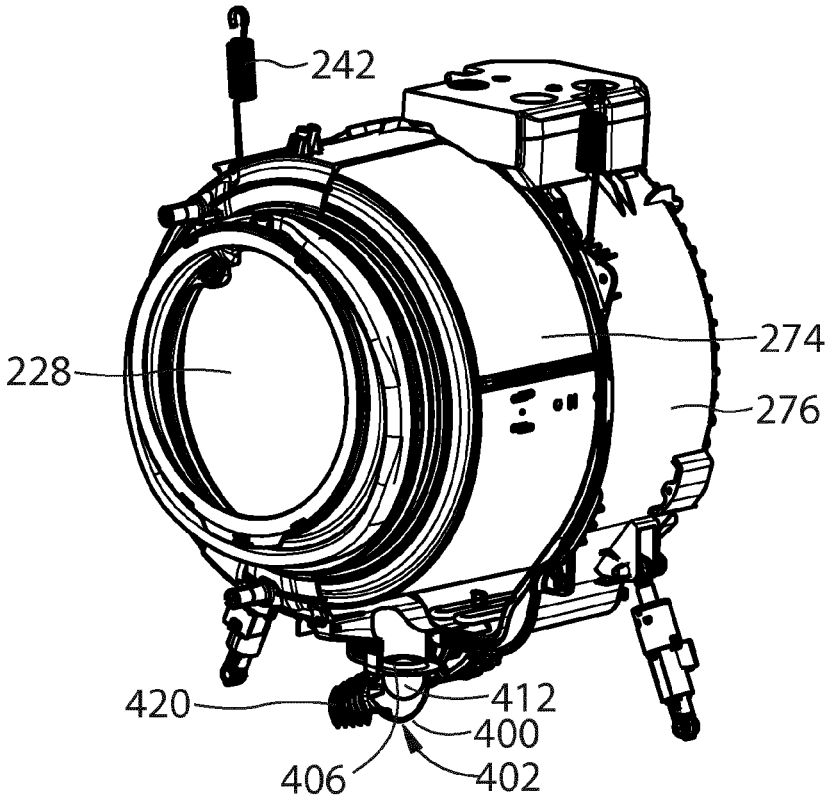
FIG. 13 shows the laundry washing machine of FIG. 12 with some components removed.
Figure 14:
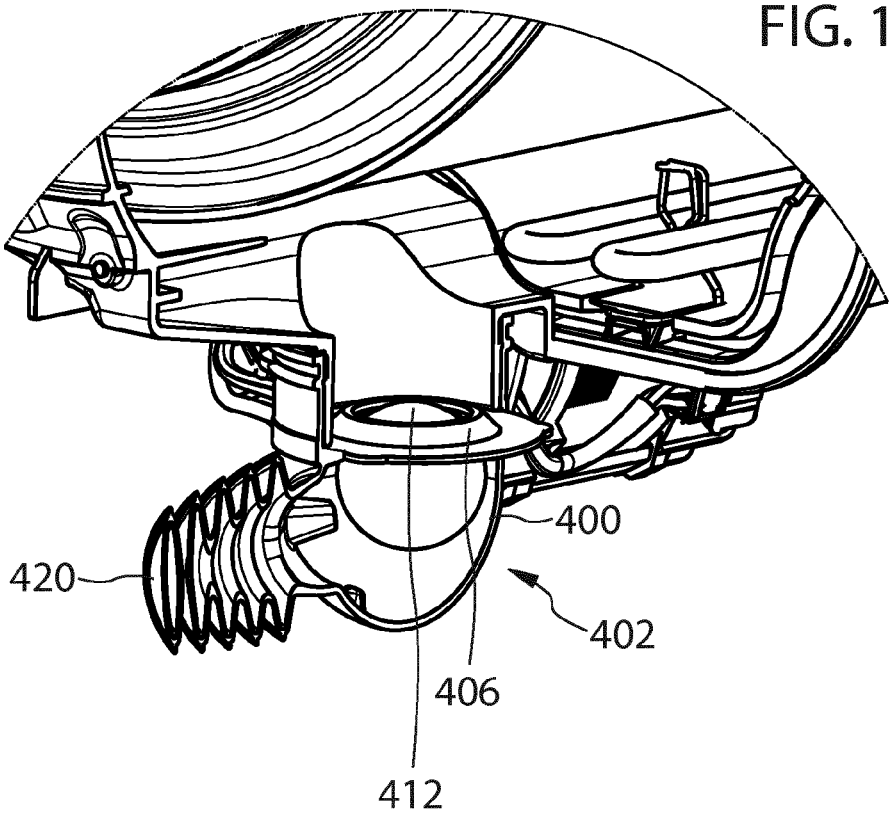
FIG. 14 shows a cut through the laundry washing machine of FIG. 12.

In FIG. 5, another preferred embodiment is shown which is performed in a washing machine without a recirculation circuit. A laundry machine which is especially suited for performing this embodiment is discussed in connection with FIGS. 12, 13, and 14.

In step 6 of this embodiment, a rinse maintenance phase is performed. In a step 10, the drain pump is activated, and water is drained from the laundry. In a step 14, the drum is revolved at a high revolving speed, while continuously water is extracted from the laundry and dripping into the tub due to the large centrifugal force. This water is drained from the tub for a defined time. In a step 18, spinning of the drum is stopped and the drain pump is deactivated. The laundry after step 18 is in a state where it can absorb water.

In a subsequent water loading/saturation phase enclosed by contour 140, in a saturation step 142, fresh water is loaded into the tub, preferably through a pre-wash or another compartment which is essentially empty. Fresh water is loaded into the tub until the water level in the tub is high enough to allow wetting of the laundry through the drum. This means that the water levels is a least higher than the bottom of the drum. The laundry washing machine is configured in such a way that when the water level is so high that it reaches, especially through holes or perforations, into the drum and gets absorbed by the laundry, the amount of water in the tub is able to lead to a saturation of the laundry. During drum rotation for a defined time in a step 144, water is carried with the drum to higher elevations and is then falling back into the tub and onto the laundry. In a step 146, water is loaded into the tub through the fabric softener compartment.

During a rinse maintenance phase, labeled by a dashed contour 150, in a step 152 the drum is tumbling for a defined time. Subsequently, in a drain and spin phase (contour 160), in a step 162 the drain pump is activated, and water is drained from the tub. Subsequently, in a step 164 the drum is rotated at high rpm for a defined time while the drain pump is active, resulting in a continuous drain.

Figure 6:
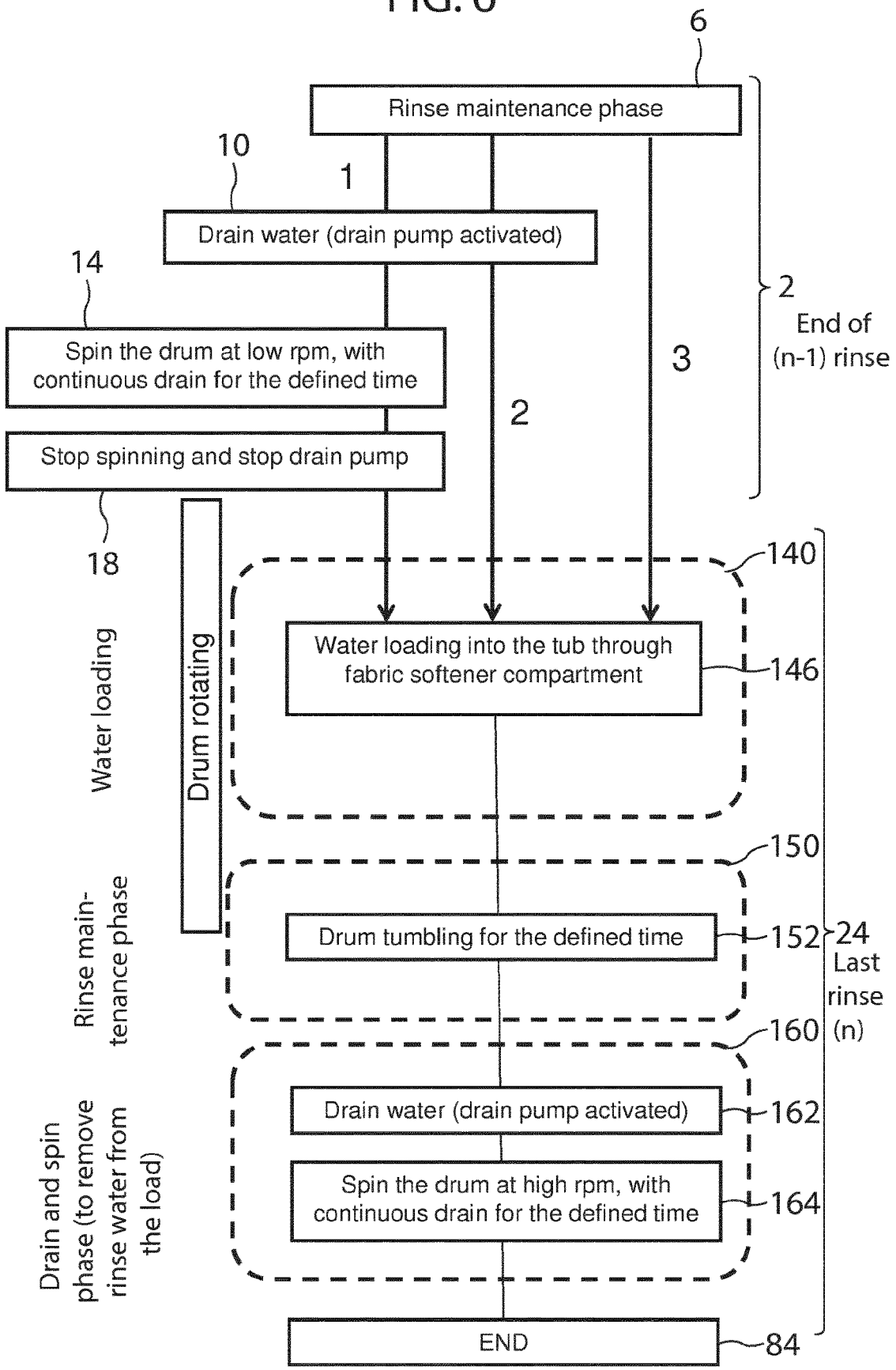
FIG. 6 shows a flow diagram of a method for treating laundry in a laundry washing machine in three further preferred embodiments.

In FIG. 6, three further preferred embodiments are shown which are alterations of the embodiment shown in FIG. 5. In a first of these embodiments, step 6 with the rinse maintenance phase is followed by step 10, in which water is drained from the tub. In step 14, the drum is rotated at low rpm, while continuously water is drained for a defined time. In a subsequent step 18, spinning and draining are stopped.

In a subsequent water loading phase 140, a step 146 is performed in which water is loaded into the tub through the fabric softener compartment. Due to the spinning of the drum with low rpm, the laundry enters the water loading/wetting phase already in a saturated state; hence water loading into the tub before step 146 is not necessary.

During a rinse maintenance phase, labeled by a dashed contour 150, in a step 152 the drum is tumbling for a defined time. Subsequently, in a drain and spin phase (contour 160), in a step 162 the drain pump is activated, and water is drained from the tub. Subsequently, in a step 164 the drum is rotated at high rpm for a defined time while the drain pump is active, resulting in a continuous drain.

The second embodiment shown in FIG. 6 comprises a rinse maintenance phase step 6 which is followed by a step 10 in which water is drained. The laundry is saturated with water which it has absorbed during the previous rinse step(s). The method jumps from step 10 to step 146. In step 146, water is loaded into the tub through the fabric softener compartment.

During a rinse maintenance phase, labeled by a dashed contour 150, in a step 152 the drum is tumbling for a defined time. Subsequently, in a drain and spin phase (contour 160), in a step 162 the drain pump is activated, and water is drained from the tub. Subsequently, in a step 164 the drum is rotated at high rpm for a defined time while the drain pump is active, resulting in a continuous drain.

The third embodiment shown in FIG. 6 differs from the second embodiment by the omission of steps 14, 18, which means that step 6 is followed by step 146, the method jumps from step 6 to step 146.

The embodiments shown in FIGS. 5 and 6 can also be combined with a recirculation phase or step of water/additive, especially a recirculation from a lower part of the tub to another lower part of the tub, preferably after the additive has been supplied to the tub, which further enhances the homogeneity of the water/additive mixture in the tub. In such a recirculation phase, the mixture of additive and water can be improved and made more homogeneous. Such a phase can be performed as discussed in connection with the previous embodiments.

Figure 7:
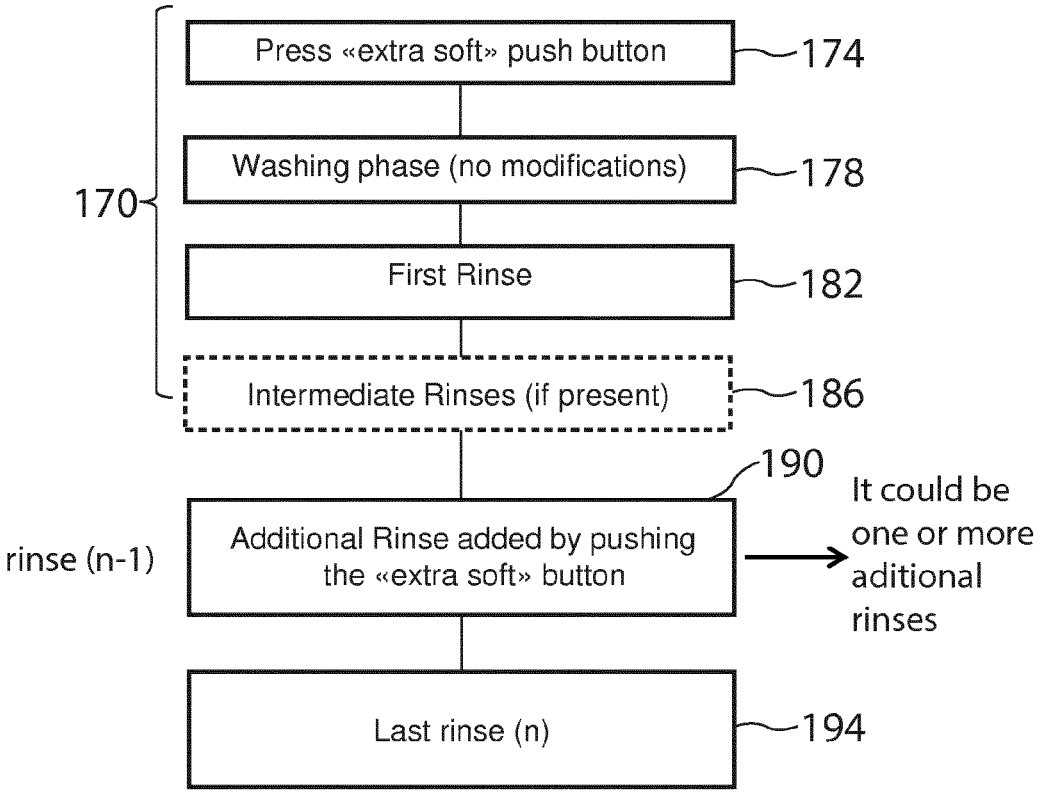
FIG. 7 shows a flow diagram of a method for treating laundry in a laundry washing machine in still another preferred embodiment with a user-selectable extra rinse phase.

In FIG. 7, still another preferred embodiment of the method is displayed in a flow chart. In this embodiment, the curly brace 170 encloses the steps before the second last rinse. This embodiment is performed in a laundry washing machine which provides a user element or rinse select part which is configured to receive user input regarding an "extra soft" property of the laundry treatment routine. This rinse select part can be designed as a push button and/or rotatable knob and/or capacitive sensor and/or touchscreen and is advantageously provided on a user interface of the laundry machine. By activating this rinse select part, the user influences the number of rinses and/or parameter related to them. In the embodiment shown, the user can add one or more extra/additional rinses. In a first example, the method can comprise a first rinse step, 2 intermediate rinse steps, 2 additional rinse steps selected by the user, and a last rinse step, adding to a total of 6 rinse steps. In a second example, the method can comprise a first rinse step, 1 intermediate rinse step, 2 or 3 additional rinse steps selected by the user, and a last rinse steps, adding to a total of 5 or 6 rinse steps.

In a step 174, it is checked if the user has chosen that an extra rinse cycle should be conducted. In a step 178, a washing phase is conducted without any modifications. In other words, the user input via the user element does not influence the parameters of the washing phase. In a subsequent step 182 after the washing phase, a first rinse cycle is conducted. In a step 186, one or several intermediate rinse cycles may be conducted. In a step 190, an additional rinse cycle or phase is added if the user has chosen this option via the user element. In a last rinse cycle in a step 194, the rinsing is performed as described in the previous embodiments of the invention. In this last rinse, before water/additive are introduced into the tub, the laundry is provided with water to be in a saturated state.

Figure 8:
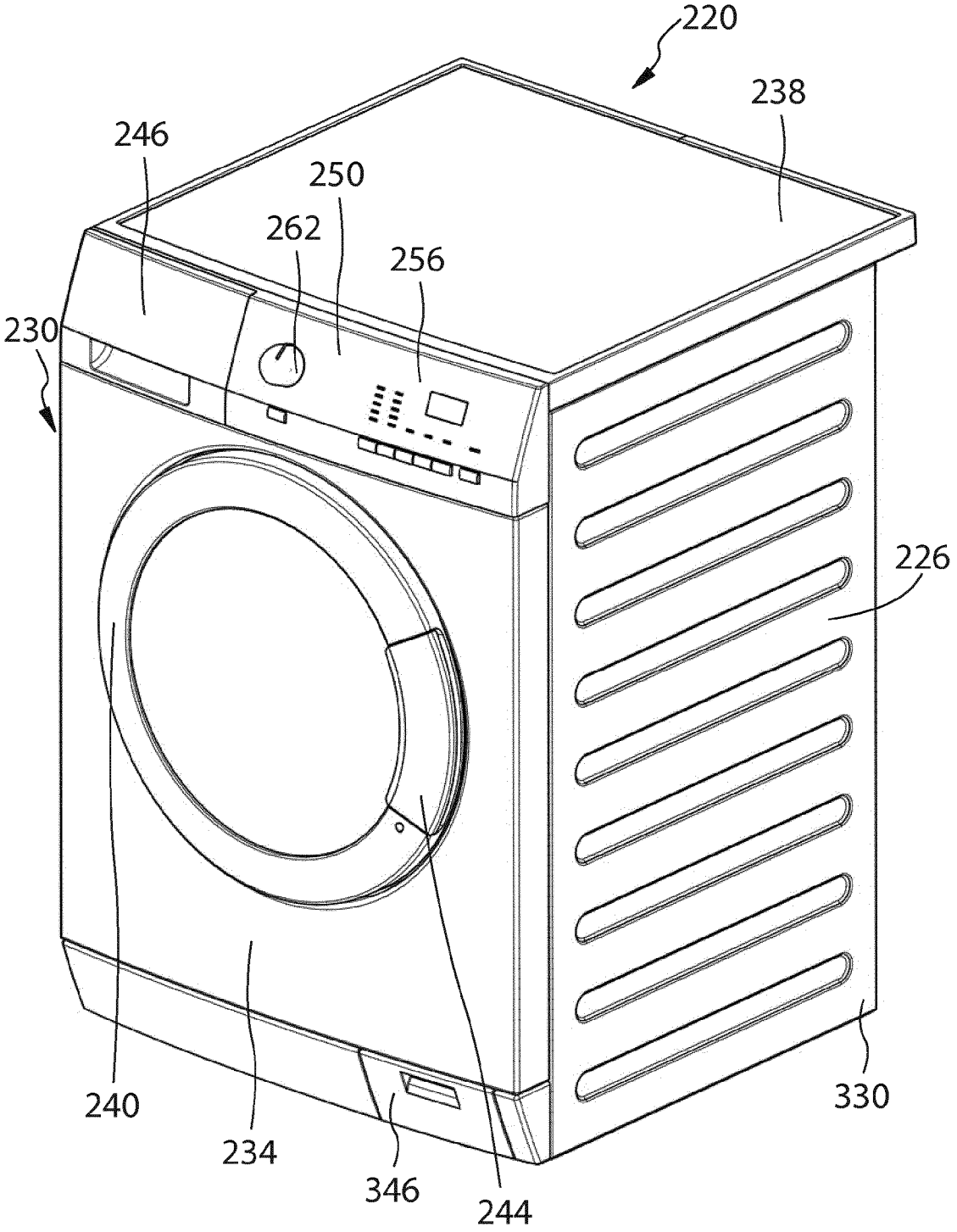
FIG. 8 shows a preferred embodiment of a front-loading laundry washing machine in a perspective view.
Figure 9:
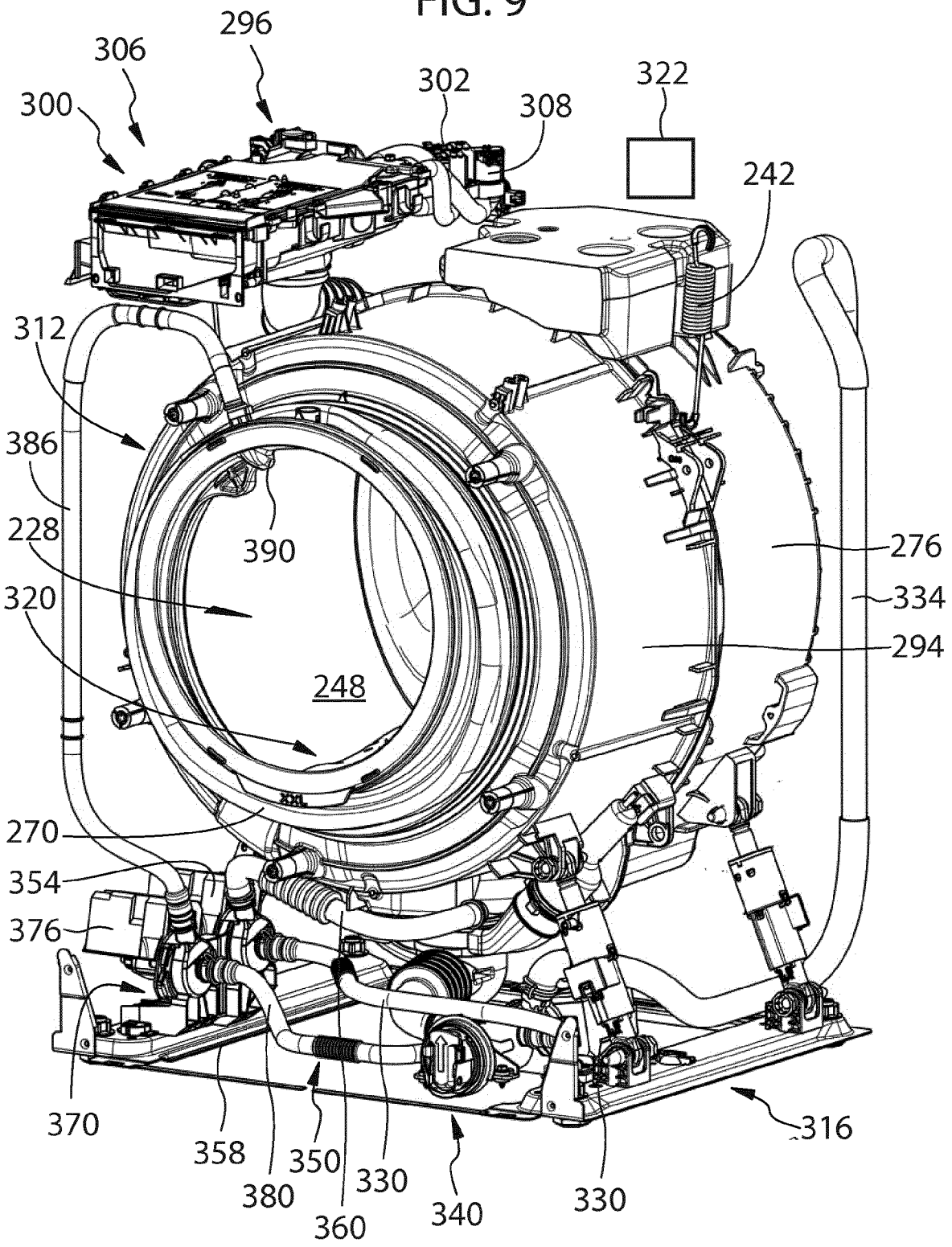
FIG. 9 shows the laundry washing machine of FIG. 8 with the casing removed.
Figure 10:
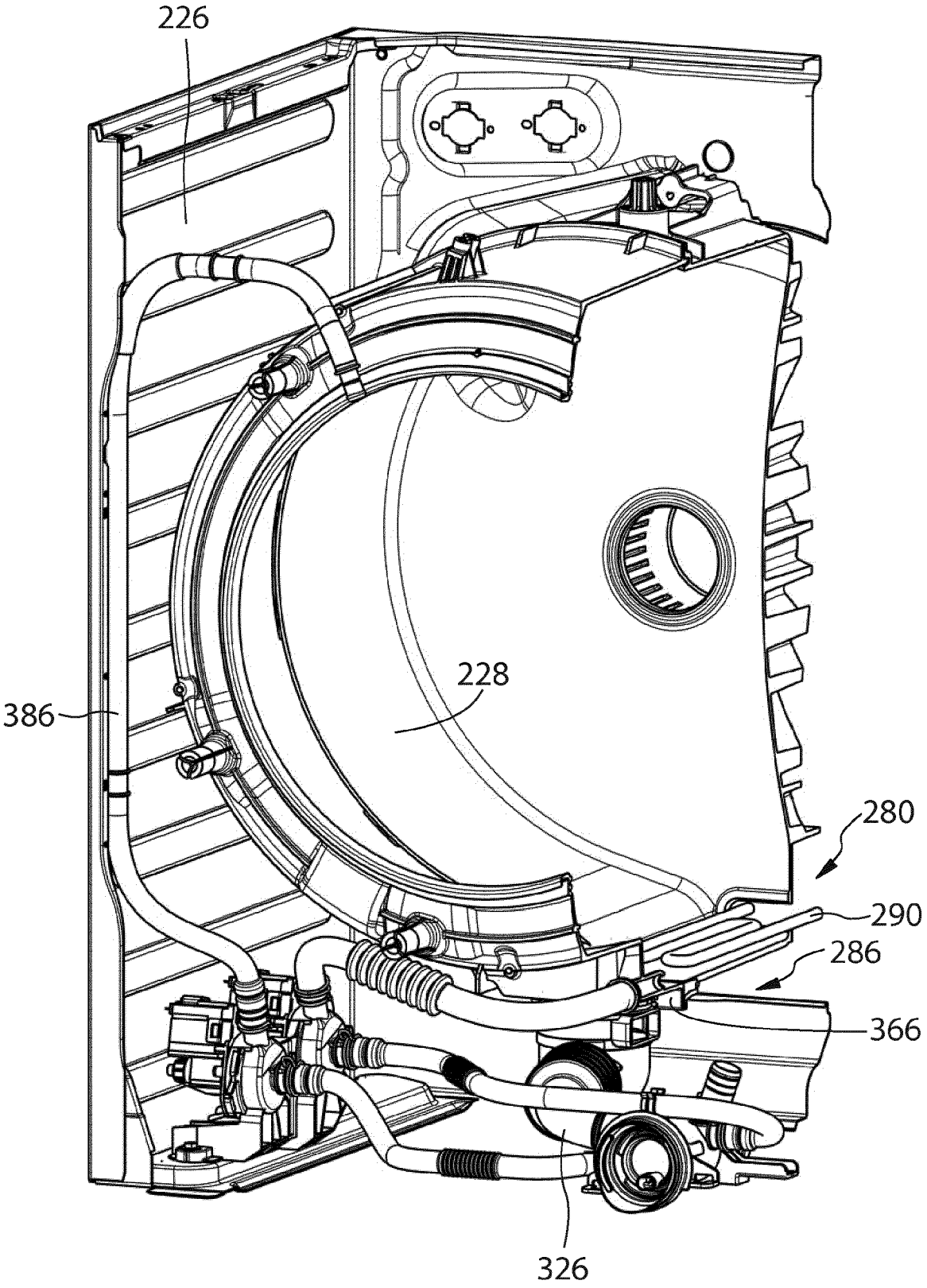
FIG. 10 shows the laundry machine of FIG. 8 with some components removed.

With reference to FIGS. 8, 9 and 10, a front-loading laundry washing machine 220 is shown which comprises an external housing or casing 226 comprising two side walls 230, a front wall 234, a back wall (not shown) and a top plate 238. Inside casing 226, a washing tub 228 is provided which contains a perforated washing drum 248 into which the laundry to be treated can be loaded. The tub 228 and drum 248 have both preferably an essentially cylindrical shape. Tub 228 is preferably suspended in a floating manner inside casing 226, advantageously by means of a number of coil springs and shock absorbers 242.

Casing 226 is provided with a door 240 for loading/unloading of laundry with a handle 244 for operating the door 240. The drum is advantageously rotated by an electric motor (not shown) which preferably transmits the rotating motion to a shaft of the drum, advantageously by means of a belt/pulley system. In a different embodiment, the motor can directly be associated with the shaft of the drum. Tub 228 is preferably connected to casing 226 by means of an elastic bellows 270 or gasket. Tub 228 preferably comprises two complementary hemi-shells 274, 276 structured for being reciprocally coupled to form tub 228. The bottom region 280 of tub 228 preferably comprises a seat or sump 286, suitable for receiving a heating device 290. The heating device, when activated, heats the liquid inside sump 286.

A water supply circuit 296 which can be built according to the known art is arranged at the upper part of the laundry washing machine 220 and is suited to supply water into tub 228. It advantageously comprises at least one supply valve which is properly controlled, opened and closed, during the washing cycle. In the present embodiment, water supply circuit 296 comprises two supply valves 302, 308.

The laundry washing machine comprises a detergent supplier 300 to supply detergent into tub 228 and a rinse additive supplier 306.

Laundry treatment machine 220 comprises on its frontal side a removable drawer 246 of which detergent supplier 300 and rinse additive supplier 306 are a part of. Drawer 246 is provided with various compartments suited to be filled with washing products, especially a detergent, and at least one a rinse additive, especially a fabric softener. Laundry treatment machine 220 further comprises a front panel 250 with a user interface 256, preferably comprising indicators for the current state of the machine and/or user elements. Front panel 250 further comprises a user element 262 for interacting with the machine which is preferably built as a rotatable push button.

In different embodiments, nevertheless, the removable drawer 246 may comprise further compartments suited to be filled with other type of rinse additives, such as fabric conditioners, waterproofing agents, fabric enhancers, rinse sanitization additives, chlorine-based additives, i.e. products which are suitable to be used in the rinsing phase of the washing program (as will be described in details along this description).

In the preferred embodiment here illustrated, the water is supplied into the tub 228 from the water supply circuit 296 by making it flow through the drawer 246 and then through a supply pipe. The water which reaches the tub 228 can, in this case, selectively contain one of the products contained in the compartments of the drawer 246. Such water can be clean if the product in the drawer 246 has been already removed.

In an alternative embodiment of the invention, a further separate water supply pipe can be provided, which supplies exclusively clean water into the tub 228, thus bypassing the compartments of the drawer 246.

The water supply circuit 296 also preferably comprises a water flow sensor, for example a flow meter, which makes it possible to calculate the quantity of water supplied into the tub 228. The supply pipe is preferably arranged laterally with respect to the tub 228 and preferably terminates at an upper region 312 of the tub 228. More preferably, the supply pipe terminates at a rear side of the washing tub 228.

The water supply circuit 296 may then preferably comprise a water softening device for removal of calcium, magnesium and/or certain other metal cations in hard water before entering the tub. The water softening device advantageously comprises water softening agents for reducing the hardness degree of the water to be supplied to the washing tub. Furthermore, the water supply circuit 296 may comprise a regeneration-agent reservoir which is housed inside the casing and is structured for receiving salt or other regeneration agents for regenerating a water softening function of the water softening agents.

Laundry washing machine 220 advantageously comprises a water outlet circuit 316 suitable for withdrawing liquid from a bottom region 320 of the tub 228. The water outlet circuit 316 preferably comprises a main pipe 326, a draining pump 330 and an outlet pipe 334 ending outside the housing or casing 226.

The water outlet circuit 316 or draining circuit preferably further comprise a filtering device 340 arranged between the main pipe 326 and the draining pump 330. The filtering device 340 is adapted to retain all the undesirable bodies (for example buttons that have come off the laundry, coins erroneously introduced into the laundry washing machine, etc.). This filtering device 340 can preferably be removed, and then cleaned, through a gate 346 placed advantageously on the front wall of the housing casing of the laundry washing machine 220.

The main pipe 326 connects the bottom region 320 of the tub 228 to the filtering device 340. An inlet end of the main pipe 326 is advantageously positioned at the lower point of the tub 228, more preferably at the lower point of the sump 286. An outlet end of the main pipe 326 is connected to a front part of the filtering device 340.

In a further embodiment, not illustrated, the filtering device 340 may be provided directly in the tub 228, preferably obtained in a single piece construction with the latter. In this case the filtering device 340 is fluidly connected to the outlet of the tub 228, in such a way that water and washing liquid drained from the tub 228 enters the filtering device 340.

The draining pump 330 is preferably connected to a rear part of the filtering device 340 and conveys the liquid to the outlet pipe 334 through an outlet. Activation of the drain pump 330 drains the liquid, i.e. dirty water or water mixed with washing and/or rinsing products, from the tub 228 to the outside.

Laundry washing machine 220 advantageously comprises a first recirculation circuit or mixing circuit 350. The mixing circuit 350 is adapted to drain liquid from the bottom region 320 of the tub 228 and to re-admit such a liquid (recirculated mixing liquid) into a first region of the tub 228, which corresponds substantially to the same bottom region 320 of the tub 228. Preferably, the mixing circuit 350 is adapted to drain liquid from the bottom of the sump and to re-admit such a liquid (recirculated mixing liquid) again into the sump. More preferably, the liquid is re-admitted again into the sump 286 below the heating device 290.

The mixing circuit 350 preferably comprises a first recirculation pump 354, a first pipe 358 connecting the filtering device 340 to the first recirculation pump 354 and a second recirculation pipe 360 advantageously provided with a terminal portion 366, or nozzle. The terminal portion advantageously ends inside the sump 286, as mentioned above.

The liquid from the bottom region 320 of the tub 228 is conveyed again towards the bottom region 320 of the tub 228 by activation of the first recirculation pump 354. Advantageously, the liquid from the bottom region 320 of the tub 228 is conveyed towards the bottom region 320 of the tub 228 in a gap between the tub 228 and the drum. In a further embodiment, not illustrated, the mixing circuit may comprise a dedicated pipe connecting the bottom region of the tub 228 to the recirculation pump; in this case the mixing circuit is advantageously completely separated from the water outlet circuit, i.e. completely separated from the filtering device 340 and the main pipe 326.

The mixing circuit (first recirculation circuit 350) is preferably realized for transferring a portion of a liquid from a bottom region of the tub to the same bottom region for mixing and/or dissolution of the products, as better described below. In general, the mixing circuit (first recirculation circuit) is preferably realized for transferring liquid from a bottom region of the tub and for re-admitting such a liquid into the washing tub such that at least a portion of the re-admitted liquid reaches the bottom region of the washing tub without entering the washing drum.

More preferably, the mixing circuit (first recirculation circuit 350) is preferably realized for transferring liquid from a bottom region of the tub and for re-admitting such a liquid into the washing tub such that all, or substantially all, the re-admitted liquid reaches the bottom region of the washing tub without entering the washing drum.

Laundry washing machine 220 preferably comprises a second recirculation circuit 370 adapted to drain liquid from the bottom region 320 of the tub 228 and to re-admit such a liquid into a second region 312, or upper/higher region, of the tub 228. The second recirculation circuit 370 preferably comprises a second recirculation pump 376, a second pipe 380 connecting the filtering device 340 to the second recirculation pump 376 and a second recirculation pipe 386, preferably provided with a terminal nozzle 390 arranged preferably at the upper region 312 of the tub 228. The terminal nozzle 390 is opportunely arranged so that the liquid is sprayed directly into the drum. More preferably the terminal nozzle 390 is integrally formed in the bellows, and the liquid is therefore advantageously sprayed in a direction the center of the perforated drum. The terminal nozzle 390, therefore, enhances distribution of liquid over the laundry through the perforated drum.

The liquid from the bottom region 320 of the tub 228 is conveyed towards the upper region 312 of the tub 228 by activation of the second recirculation pump 386. The second recirculation circuit 370 is advantageously activated in order to improve wetting of the laundry inside the drum 348 and for reducing the water required in the whole washing program. In general, the second recirculation circuit 370 is properly realized for transferring a portion of a liquid from a bottom region of the tub 228, preferably from the sump 286, to an upper region of the tub in order to enhance absorption of the liquid by the laundry.

Advantageously, laundry washing machine 220 comprises a device suited to sense (or detect) the liquid level inside the tub 228. The sensor device preferably comprises a pressure sensor which senses the pressure in the tub 228. From the values sensed by the sensor device it is possible to determine the liquid level of the liquid inside the tub 228. In another embodiment, not illustrated, laundry washing machine 220 may preferably comprise (in addition to or as a replacement of the pressure sensor) a level sensor (for example mechanical, electro-mechanical, optical, etc.) adapted to sense (or detect) the liquid level inside the tub 228.

Laundry washing machine 220 comprises a control unit 322, connected to the various parts of the laundry washing machine 220 in order to ensure its operation. The control unit is preferably connected to the water inlet or supply circuit 296, the water outlet circuit, the recirculation circuits 350, 370, the heating device 290 and the electric motor and receives information from the various sensors provided on the laundry washing machine 220, like possibly the pressure sensor, a temperature sensor, etc.

The user interface 250 is connected to the control unit 322, accessible to the user and by means of which the user may select and set the washing parameters, like for example a desired washing program. Usually, other parameters can optionally be inserted by the user, for example the washing temperature, the spinning speed, the load in terms of weight of the laundry to be washed, etc. Based on the parameters acquired by said interface 250, the control unit sets and controls the various parts of the laundry washing machine 220 in order to carry out the desired washing program.

Laundry washing machine 220 is adapted to conduct a method described above, especially in its embodiments shown in FIGS. 1 and 2. To this end, the method is implemented in the control unit 322 as software instructions and/or hardware circuit, wherein preferably the control unit comprises a processor on which software instructions are executed. For draining liquid from the tub 228, the draining pump 230 is activated. Fresh water is introduced into tub 228 by activating the respective supply valve 302, 308. The fresh or clean water is then running through a wash compartment into the tub 228. The recirculation circuits 350, 370 can be employed as described above by activating/deactivating the respective recirculation pump 354, 376. The sensor for detecting the water level can be employed to monitor if the water level of free water is rising in the tub 228, indicating that the laundry is not able to continue to absorb water and is in a saturated or even over-saturated state.

The user element 262 allows the user to select at least one additional rinse cycle and/or the performance of the saturation step. In alternative embodiments, for selecting additional rinse cycles and/or the saturation step, another user element or a different user element can be provided, for example a touch button or a touch screen.

Figure 11:
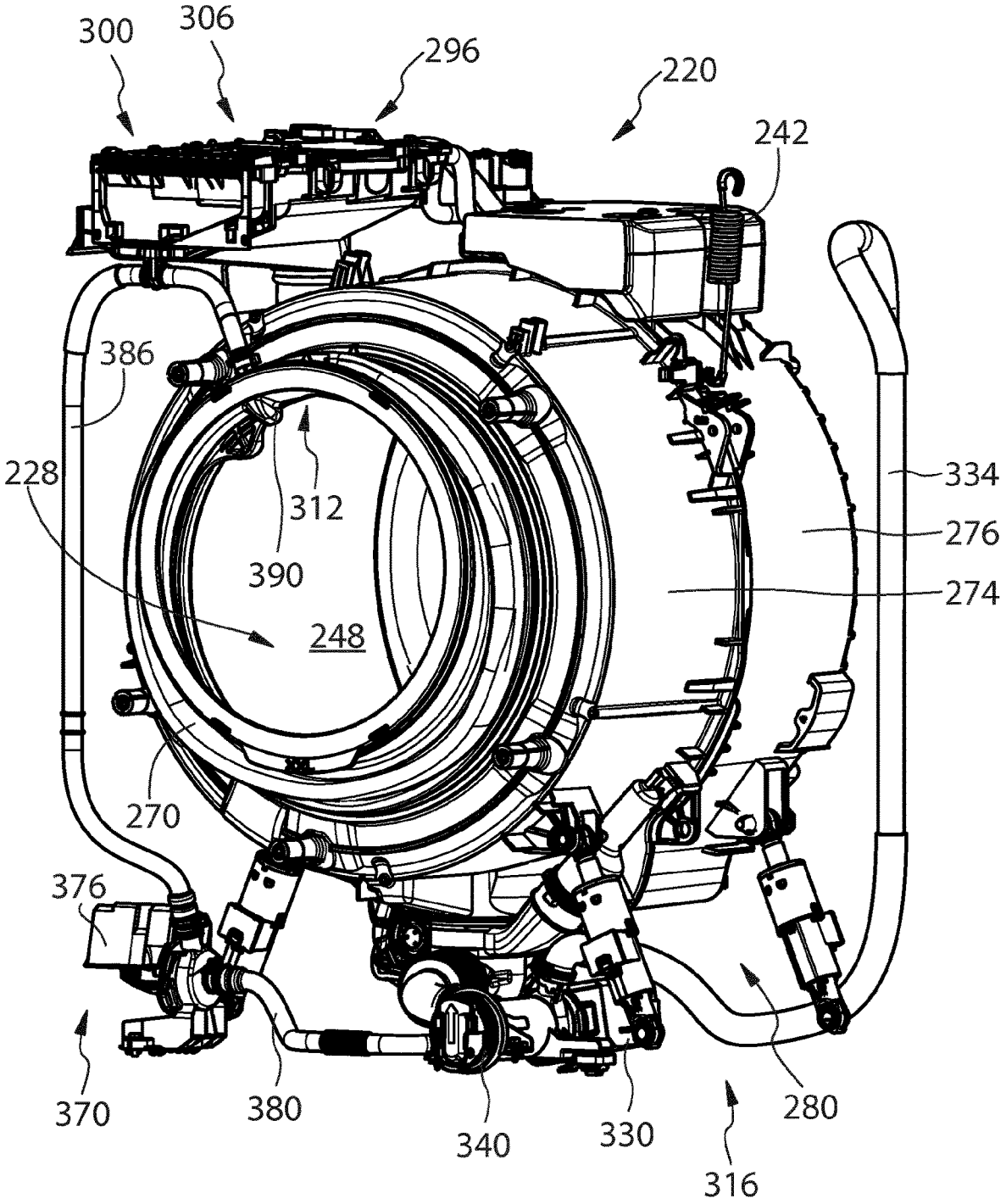
FIG. 11 shows still another preferred embodiment of a laundry washing machine with the casing removed in a perspective view.

With reference to FIG. 11, another preferred embodiment of a front-loading laundry washing machine 220 is shown which comprises an external housing or casing, which is removed in the drawing. The casing can be designed as shown in FIG. 8. Inside the casing, a washing tub 228 is provided which contains a perforated washing drum 248 into which the laundry to be treated can be loaded. The tub 228 and drum 248 have both preferably an essentially cylindrical shape. Tub 228 is preferably suspended in a floating manner inside casing, advantageously by means of a number of coil springs and shock absorbers 242.

The casing is provided with a door for loading/unloading of laundry with a handle for operating the door. The drum is advantageously rotated by an electric motor (not shown) which preferably transmits the rotating motion to a shaft of the drum, advantageously by means of a belt/pulley system. In a different embodiment, the motor can directly be associated with the shaft of the drum. Tub 228 is preferably connected to casing by means of an elastic bellows 270 or gasket. Tub 228 preferably comprises two complementary hemi-shells 274, 276 structured for being reciprocally coupled to form tub 228. The bottom region 280 of tub 228 preferably comprises a seat or sump, suitable for receiving a heating device. The heating device, when activated, heats the liquid inside sump.

A water supply circuit 296 which can be built according to the known art is arranged at the upper part of the laundry washing machine 220 and is suited to supply water into tub 228. It advantageously comprises at least one supply valve which is properly controlled, opened and closed, during the washing cycle. The laundry washing machine comprises a detergent supplier 300 to supply detergent into tub 228 and a rinse additive supplier 306.

Laundry treatment machine 220 comprises on its frontal side a removable drawer of which detergent supplier and rinse additive supplier are a part of. The drawer is provided with various compartments suited to be filled with washing products, especially a detergent, and at least one a rinse additive, especially a fabric softener. Laundry treatment machine 220 further comprises a front panel with a user interface, preferably comprising indicators for the current state of the machine and/or user elements. Front panel further comprises a user element for interacting with the machine which is preferably built as a rotatable push button.

In different embodiments, nevertheless, the removable drawer may comprise further compartments suited to be filled with other type of rinse additives, such as fabric conditioners, waterproofing agents, fabric enhancers, rinse sanitization additives, chlorine-based additives, i.e. products which are suitable to be used in the rinsing phase of the washing program (as will be described in details along this description).

In the preferred embodiment here illustrated, the water is supplied into the tub 228 from the water supply circuit 296 by making it flow through the drawer 246 and then through a supply pipe. The water which reaches the tub 228 can, in this case, selectively contain one of the products contained in the compartments of the drawer 246. Such water can be clean if the product in the drawer 246 has been already removed.

In an alternative embodiment of the invention, a further separate water supply pipe can be provided, which supplies exclusively clean water into the tub 228, thus bypassing the compartments of the drawer 246.

The water supply circuit 296 also preferably comprises a water flow sensor, for example a flow meter, which makes it possible to calculate the quantity of water supplied into the tub 228. The supply pipe is preferably arranged laterally with respect to the tub 228 and preferably terminates at an upper region 312 of the tub 228. More preferably, the supply pipe terminates at a rear side of the washing tub 228.

The water supply circuit 296 may then preferably comprise a water softening device for removal of calcium, magnesium and/or certain other metal cations in hard water before entering the tub. The water softening device advantageously comprises water softening agents for reducing the hardness degree of the water to be supplied to the washing tub. Furthermore, the water supply circuit 296 may comprise a regeneration-agent reservoir which is housed inside the casing and is structured for receiving salt or other regeneration agents for regenerating a water softening function of the water softening agents.

Laundry washing machine 220 advantageously comprises a water outlet circuit 316 suitable for withdrawing liquid from a bottom region 320 of the tub 228. The water outlet circuit 316 preferably comprises a main pipe 326, a draining pump 330 and an outlet pipe 334 ending outside the housing or casing 226.

The water outlet circuit 316 or draining circuit preferably further comprise a filtering device 340 arranged between the main pipe 326 and the draining pump 330. The filtering device 340 is adapted to retain all the undesirable bodies (for example buttons that have come off the laundry, coins erroneously introduced into the laundry washing machine, etc.). This filtering device 340 can preferably be removed, and then cleaned, through a gate 346 placed advantageously on the front wall of the housing casing of the laundry washing machine 220.

The main pipe 326 connects the bottom region 320 of the tub 228 to the filtering device 340. An inlet end of the main pipe 326 is advantageously positioned at the lower point of the tub 228, more preferably at the lower point of the sump 286. An outlet end of the main pipe 326 is connected to a front part of the filtering device 340.

In a further embodiment, not illustrated, the filtering device 340 may be provided directly in the tub 228, preferably obtained in a single piece construction with the latter. In this case the filtering device 340 is fluidly connected to the outlet of the tub 228, in such a way that water and washing liquid drained from the tub 228 enters the filtering device 340.

The draining pump 330 is preferably connected to a rear part of the filtering device 340 and conveys the liquid to the outlet pipe 334 through an outlet. Activation of the drain pump 330 drains the liquid, i.e. dirty water or water mixed with washing and/or rinsing products, from the tub 228 to the outside.

The laundry machine 220 shown in FIG. 11 does not comprise a mixing circuit or first recirculation circuit as the embodiment show in FIG. 10.

Laundry washing machine 220 preferably comprises a second recirculation circuit 370 adapted to drain liquid from the bottom region 320 of the tub 228 and to re-admit such a liquid into a second region 312, or upper/higher region, of the tub 228. The second recirculation circuit 370 preferably comprises a second recirculation pump 376, a second pipe 380 connecting the filtering device 340 to the second recirculation pump 376 and a second recirculation pipe 386, preferably provided with a terminal nozzle 390 arranged preferably at the upper region 312 of the tub 228. The terminal nozzle 390 is opportunely arranged so that the liquid is sprayed directly into the drum. More preferably the terminal nozzle 390 is integrally formed in the bellows, and the liquid is therefore advantageously sprayed in a direction the center of the perforated drum. The terminal nozzle 390, therefore, enhances distribution of liquid over the laundry through the perforated drum.

The liquid from the bottom region 320 of the tub 228 is conveyed towards the upper region 312 of the tub 228 by activation of the second recirculation pump 386. The second recirculation circuit 370 is advantageously activated in order to improve wetting of the laundry inside the drum and for reducing the water required in the whole washing program. In general, the second recirculation circuit is properly realized for transferring a portion of a liquid from a bottom region of the tub, preferably from the sump, to an upper region of the tub in order to enhance absorption of the liquid by the laundry.

Advantageously, laundry washing machine 220 comprises a device suited to sense (or detect) the liquid level inside the tub 228. The sensor device preferably comprises a pressure sensor which senses the pressure in the tub 228. From the values sensed by the sensor device it is possible to determine the liquid level of the liquid inside the tub 228. In another embodiment, not illustrated, laundry washing machine may preferably comprise (in addition to or as a replacement of the pressure sensor) a level sensor (for example mechanical, electro-mechanical, optical, etc.) adapted to sense (or detect) the liquid level inside the tub 228.

Laundry washing machine 220 comprises a control unit, not illustrated, and connected to the various parts of the laundry washing machine 220 in order to ensure its operation. The control unit is preferably connected to the water inlet circuit, the water outlet circuit, the recirculation circuits, the heating device 290 and the electric motor and receives information from the various sensors provided on the laundry washing machine 220, like possibly the pressure sensor, a temperature sensor, etc.

The user interface 250 is connected to the control unit, accessible to the user and by means of which the user may select and set the washing parameters, like for example a desired washing program. Usually, other parameters can optionally be inserted by the user, for example the washing temperature, the spinning speed, the load in terms of weight of the laundry to be washed, etc. Based on the parameters acquired by said interface 250, the control unit sets and controls the various parts of the laundry washing machine 220 in order to carry out the desired washing program.

Laundry washing machine 220 is adapted to conduct a method described above, especially in its embodiments shown in FIGS. 3 and 4. To this end, the method is implemented in the control unit as software instructions and/or hardware circuit, wherein preferably the control unit comprises a processor on which software instructions are executed. For draining liquid from the tub 228, the draining pump 230 is activated. Fresh water is introduced into tub 228 by activating the supply valve. The fresh or clean water is then running through a wash compartment into the tub 228. The recirculation circuits 370 can be employed as described above by activating/deactivating the respective recirculation pump 376. The sensor for detecting the water level can be employed to monitor if the water level of free water is rising in the tub, indicating that the laundry is not able to continue to absorb water and is in a saturated or even over-saturated state.

Still another preferred embodiment of a laundry washing machine 220 adapted to perform a method described above is shown in FIGS. 12, 13, and 14. Laundry washing machine 220 comprises a water outlet circuit 216 or draining circuit with a draining pump 330. A valve 402 comprising a valve body 400 and a valve seat 406 which is built as a diaphragm with an opening is arranged between tub 228 and water outlet circuit 216. A ball 412, which acts as valve element, is freely moveable or floatable between valve seat 406 and filter element 340 and is adapted to engage with valve seat 406 to shut the tub 228 from the water outlet circuit 216. The ball 412 is made of floatable material, e.g. plastic, and floats on the water depending on the water level in the valve body 400/draining suction pipe 420.

When the water level in pipe 420 is high, ball 412 is pressed against valve seat 406 and divides a space upstream and downstream. In such a position, the water to be filled into the tub can be heated, reducing the energy consumption for heating of the water.

This embodiment of a laundry machine 220 is especially enabled to conduct a method described in connection with the FIGS. 5, 6 and 7. It is, however, also possible to conduct this method by a laundry washing machine without the valve 402.

This embodiment of a laundry washing machine can also be provided with a mixing circuit as described in the connection with the previous embodiment of the laundry washing machine, the mixing circuit comprising a mixing pump, which, when activated, drains fluid from a lower part of the tub to again the lower part of the tub, whereby the water/additive admixture is mixed and thereby made more homogenous. Both the inlet and the outlet of this mixing circuit are then arranged upstream of the valve 402 and ball 412, meaning they are arranged on the opposite side of the ball 412 with respect to pipe 420.

The valve 402 then opens due to the lower water level. During a draining phase, valve 402 also opens such that water can be drained from tub 228 to the outside. Valve 402 is in closed position during normal washing or rinsing phases in which the amount/kind of liquid in the tub should not change.

The invention claimed is:

1. A method for treating laundry in a laundry washing machine, the method comprising:

carrying out at least one washing phase during which said laundry in a perforated drum of the washing machine is washed with introduction of water by a water supply circuit comprising at least one supply valve to supply the water into a washing tub of the washing machine and the introduction of detergent by a detergent supplier to supply detergent into said washing tub, and tumbled by rotation of the perforated washing drum of the washing machine, the washing drum provided with holes and adapted to receive laundry;

carrying out at least one successive draining phase for draining liquid from said washing tub and following said draining phase conducting at least one rinsing step in which said laundry is soaked with water; and carrying out a final rinsing step in which said laundry is treated by means of a rinse additive supplier to supply at least one rinse additive into said washing tub, the final rinsing step including the following:

1) in each of a plurality of successive partial water loading steps, introducing fresh water into the washing tub via the water supply circuit, such that substantially all of the fresh water reaches a bottom region of the washing tub without entering the perforated drum, spraying, by a jet pump, said laundry with the fresh water in the washing tub to saturate the laundry with the fresh water in the washing tub, and while the jet pump sprays said laundry with the fresh water:

1a) monitoring a water level in the washing tub, 1b) computing a variation of the monitored water level, and 1c) determining that the laundry is not saturated when there is a variation in the monitored water level after at least one the plurality of successive partial water loading steps, and in response to determining that there is variation in the monitored water level, continuing the introducing of the fresh water into the washing tub by continuing to perform the plurality of successive partial water loading steps, 1d) determining that the laundry is saturated when there is no variation in the monitored water level after at least one the plurality of successive partial water loading steps, and in response to determining that there is no variation in the monitored water level, stopping the introducing of the fresh water into the washing tub by stopping the performing of the plurality of successive partial water loading steps, and 2) after said laundry is saturated with the fresh water in the washing tub:

2a) introducing the rinse additive into the bottom region of the washing tub by flushing the rinse additive supplier with water, such that substantially all of the flushed rinse additive reaches the bottom region of the washing tub without entering the perforated drum, 2b) mixing, by a mixing pump, the fresh water in the washing tub with the rinse additive in the washing tub to produce a homogeneous mixture of the fresh water and the rinse additive in the bottom region of the washing tub, such that substantially all of the mixture is mixed in the bottom region of the washing tub without entering the perforated drum, and 2c) spraying, by the jet pump, said laundry with the mixture in the washing tub.

2. The method according to claim 1, wherein said saturation step comprises at least one of:

(1) extracting water from the laundry by rotating the drum at high revolving speed and draining the extracted water from the tub, and thereafter introducing fresh water into the tub;

(2) before said last rinsing cycle, the water from the previous rinsing step is not drained or water is partially drained so that rinsing water is kept into the tub in order to maintain said laundry saturated;

(3) rotating the drum at low revolving speed so as not to extract water from the laundry and draining the water not absorbed by the laundry from the tub in order to maintain said laundry saturated.

3. The method according to claim 1, wherein said saturation amount of water is determined based on the water loaded during the washing phase.

4. The method according to claim 1, wherein said saturation amount of water is determined based on at least one parameter which is detected during the washing phase.

5. The method according to claim 1, wherein said additive supply step includes a circulation step wherein the water and the additive in said tub are circulated from a lower part of said tub to another lower part of said tub so as to mix the water and additive.

6. The method according to claim 1, wherein during said final rinsing step, after providing said saturation amount of water in said tub, the water and additive in said tub are circulated from a lower part of said tub to a higher part of said tub for introducing the additive into said drum and treating said laundry.

7. The method according to claim 1, wherein the number of rinse steps and/or the saturation step are performed in dependence on at least one rinsing parameter set in said laundry washing machine.

8. The method according to claim 7, wherein said at least one rinsing parameter is selectable by a user.

9. The method according to claim 1, wherein during the plurality of successive partial water loading steps, the fresh water in the bottom region of the washing tub has a fresh water level that does not reach the perforated drum.

10. The method according to claim 1, wherein during the mixing, the mixture in the bottom region of the washing tub has a mixture level that does not reach the perforated drum.

11. A method for treating laundry in a laundry washing machine, the method comprising:

carrying out at least one washing phase during which said laundry in a perforated drum of the washing machine is washed with introduction of water by a water supply circuit comprising at least one supply valve to supply the water into a washing tub of the washing machine and the introduction of detergent by a detergent supplier to supply detergent into said washing tub, and tumbled by rotation of the perforated washing drum of the washing machine, the perforated washing drum provided with holes and adapted to receive laundry;

carrying out at least one successive draining phase for draining liquid from said washing tub and following said draining phase conducting at least one rinsing step in which said laundry is soaked with water; and carrying out a final rinsing step in which said laundry is treated by means of a rinse additive supplier to supply at least one rinse additive into said washing tub, the final rinsing step including the following:

1) in each of a plurality of successive partial water loading steps, introducing fresh water into the washing tub via the water supply circuit, such that substantially all of the fresh water reaches a bottom region of the washing tub without entering the perforated drum, spraying, by a jet pump, said laundry with the fresh water in the washing tub to saturate the laundry with the fresh water in the washing tub, and while the jet pump sprays said laundry with the fresh water:

1a) monitoring a water level in the washing tub, 1b) computing a variation of the monitored water level, and 1c) determining that the laundry is not saturated when there is a variation in the monitored water level after at least one the plurality of successive partial water loading steps, and in response to determining that there is variation in the monitored water level, continuing the introducing of the fresh water into the washing tub by continuing to perform the plurality of successive partial water loading steps, 1d) determining that the laundry is saturated when a variation in the monitored water level after at least one the plurality of successive partial water loading steps is below a variation threshold, and in response to determining that there is no variation in the monitored water level, stopping the introducing of the fresh water into the washing tub by stopping the performing of the plurality of successive partial water loading steps, and 2) after said laundry is saturated with the fresh water in the washing tub:

2a) introducing the rinse additive into the bottom region of the washing tub by flushing the rinse additive supplier with water, such that substantially all of the flushed rinse additive reaches the bottom region of the washing tub without entering the perforated drum, and 2b) mixing, by a mixing pump, the fresh water in the washing tub with the rinse additive in the washing tub to produce a homogeneous mixture of the fresh water and the rinse additive in the washing tub, such that substantially all of the mixture is mixed in the bottom region of the washing tub without entering the perforated drum, and then 2c) spraying, by the jet pump, said laundry with the mixture in the washing tub.

* * * * *